US009576466B2

(12) United States Patent
Sager et al.

(10) Patent No.: US 9,576,466 B2
(45) Date of Patent: Feb. 21, 2017

(54) BACKUP CONTACT FOR SECURITY/SAFETY MONITORING SYSTEM

(71) Applicant: Canary Connect, Inc., New York, NY (US)

(72) Inventors: Adam D. Sager, Englewood Cliffs, NY (US); Jonathan D. Troutman, Brooklyn, NY (US); Timothy Robert Hoover, Brooklyn, NY (US); Christopher I. Rill, Mamaroneck, NY (US)

(73) Assignee: Canary Connect, Inc., New York, NY (US)

( * ) Notice: Subject to any disclaimer, the term of this patent is extended or adjusted under 35 U.S.C. 154(b) by 0 days.

(21) Appl. No.: 14/930,064

(22) Filed: Nov. 2, 2015

(65) Prior Publication Data

US 2016/0125725 A1 May 5, 2016

Related U.S. Application Data

(60) Provisional application No. 62/074,708, filed on Nov. 4, 2014.

(51) Int. Cl.
*G08B 23/00* (2006.01)
*G08B 25/00* (2006.01)
(Continued)

(52) U.S. Cl.
CPC ..... *G08B 25/005* (2013.01); *G08B 13/19621* (2013.01); *G08B 19/00* (2013.01)

(58) Field of Classification Search
CPC ..... G08B 25/001
(Continued)

(56) References Cited

U.S. PATENT DOCUMENTS 6,693,530 B1 * 2/2004 Dowens ..... G08B 13/22 340/506
6,721,778 B1 4/2004 Smith
(Continued)

OTHER PUBLICATIONS

International Search Report and Written Opinion for PCT Application PCT/US15/58715 dated Feb. 5, 2016.
(Continued)

*Primary Examiner* — Toan N Pham
(74) *Attorney, Agent, or Firm* — Sheehan Phinney Bass & Green PA

(57) ABSTRACT

A method includes receiving an indication that an event has occurred in a physical space being monitored by a monitoring device that includes a plurality of sensors. In response to the indication, the method includes sending one or more primary notifications of the event over a computer-based network to each of one or more persons primarily associated with the physical space being monitored. If, after a designated amount of time, none of the primary notifications have been viewed by any of the persons primarily associated with the physical space being monitored, the method includes sending a backup notification of the event over the computer-based network to one or more persons designated as backup contacts. The backup notification is logically associated with information that the one or more backup contacts can access about the event. The logical association can be embodied by a link (e.g., a hyperlink) in the backup notification.

33 Claims, 15 Drawing Sheets

(51) Int. Cl.
*G08B 13/196* (2006.01)
*G08B 19/00* (2006.01)

(58) Field of Classification Search
USPC ..... 340/502, 539.11, 541, 628
See application file for complete search history.

(56) References Cited

U.S. PATENT DOCUMENTS

| | | | | |
|---|---|---|---|---|
| 6,965,313 | B1 | 11/2005 | Saylor | |
| 6,973,166 | B1 | 12/2005 | Tsumpes | |
| 7,015,806 | B2 | 3/2006 | Naidoo | |
| 7,026,926 | B1 | 4/2006 | Walker, III | |
| 7,216,145 | B2 | 5/2007 | Collings, III | |
| 7,443,304 | B2 | 10/2008 | Rowe | |
| 7,782,199 | B2 | 8/2010 | Issokson | |
| 8,254,893 | B2 | 8/2012 | Ratnakar | |
| 8,520,072 | B1 | 8/2013 | Slavin | |
| 8,600,008 | B2 * | 12/2013 | Kraus | A61B 5/0022 379/37 |
| 8,618,927 | B2 | 12/2013 | Wohlert | |
| 8,665,087 | B2 | 3/2014 | Greene | |
| 8,680,982 | B2 | 3/2014 | Trundle | |
| 8,862,092 | B2 | 10/2014 | Reitnour | |
| 9,142,118 | B2 | 9/2015 | Patenaude et al. | |
| 2003/0025599 | A1 | 2/2003 | Monroe | |
| 2003/0062997 | A1 | 4/2003 | Naidoo | |
| 2005/0035854 | A1 | 2/2005 | Gupta et al. | |
| 2005/0046567 | A1 | 3/2005 | Mortensen | |
| 2005/0216302 | A1 | 9/2005 | Raji et al. | |
| 2006/0158336 | A1 | 7/2006 | Nourbakhsh | |
| 2007/0037561 | A1 | 2/2007 | Bowen | |
| 2007/0153993 | A1 | 7/2007 | Cohen | |
| 2007/0205860 | A1 | 9/2007 | Jones | |
| 2008/0088428 | A1 | 4/2008 | Pitre | |
| 2008/0258913 | A1 * | 10/2008 | Busey | G08B 21/0415 340/540 |
| 2009/0289790 | A1 | 11/2009 | Issoksen | |
| 2010/0203920 | A1 | 8/2010 | Gregory | |
| 2011/0057797 | A1 | 3/2011 | Parker et al. | |
| 2011/0099049 | A1 | 4/2011 | Kwiat | |
| 2012/0013443 | A1 | 1/2012 | Poder | |
| 2012/0052837 | A1 | 3/2012 | Reich | |
| 2012/0187513 | A1 | 7/2012 | Holenarsipur | |
| 2012/0274876 | A1 | 11/2012 | Cappaert | |
| 2013/0049950 | A1 | 2/2013 | Wohlert | |
| 2014/0266669 | A1 | 9/2014 | Fadell et al. | |
| 2014/0313032 | A1 | 10/2014 | Sager et al. | |
| 2014/0320312 | A1 | 10/2014 | Sager et al. | |
| 2014/0327555 | A1 | 11/2014 | Sager et al. | |
| 2015/0077250 | A1 | 3/2015 | Lee | |
| 2015/0173674 | A1 | 6/2015 | Hayes et al. | |
| 2015/0180708 | A1 | 6/2015 | Jacob et al. | |
| 2015/0245189 | A1 | 8/2015 | Nalluri et al. | |
| 2015/0261769 | A1 | 9/2015 | Ono et al. | |

OTHER PUBLICATIONS

International Search Report and Written Opinion for PCT Application PCT/US14/35208, dated Dec. 2, 2014.

* cited by examiner

BACKUP CONTACT FOR SECURITY/SAFETY MONITORING SYSTEM

CROSS-REFERENCE TO RELATED APPLICATION(S)

This application claims the benefit of priority to U.S. Provisional Patent Application No. 62/074,708, entitled, Backup Contacts for Security/Safety Monitoring System, which was filed on Nov. 4, 2014. The disclosure of the prior application is incorporated by reference herein in its entirety.

FIELD OF THE INVENTION

This disclosure relates to a security/safety monitoring system and, more particularly, a security/safety monitoring system that involves backup contacts to help ensure timely and appropriate responses to events that may warrant attention in a space being monitored.

BACKGROUND

Some traditional home security systems use sensors mounted on doors and windows. These systems can sound an alarm and some even include remote monitoring for sounded alarms. These systems, however, fall short on intelligence and interactive functionalities, especially in ensuring adequate and efficient allocation of resources to address any potential security issues that may arise during monitoring.

SUMMARY OF THE INVENTION

In one aspect, a method includes receiving an indication (e.g., at a computer-based processing device) that an event has occurred in a physical space being monitored by a monitoring device that includes a plurality of sensors. In response to the received indication, the method includes sending (from the computer-based processing device) one or more primary notifications of the event over a computer-based network to each of one or more persons primarily associated with the physical space being monitored. Then, if, after a designated amount of time, none of the primary notifications have been viewed (acknowledged/acted upon) by any of the persons primarily associated with the physical space being monitored, the computer-based processing device, for example, sends a backup notification of the event over the computer-based network to one or more persons designated as backup contacts. The backup notification is logically associated with information that the one or more backup contacts can access about the event.

In a typical implementation, the logical association in the backup notification is embodied by a link in the backup notification. The link may be, for example, a hyperlink or any kind of highlighted word, picture, etc. that can be selected (e.g., clicked on with a computer mouse), the selection of which will bring the user to another place (e.g., a web page, app, etc.).

Each person primarily associated with the physical space being monitored may reside (work) at (at least part-time), have an ownership interest in where the monitored space is located. Any individuals designated as backup contacts, however, typically do not reside (work) at or have an ownership interest in the monitored physical space.

The event that generates the indication is generally based on some occurrence in the monitored space that the monitoring device, for example, has determined might be undesirable (e.g., a fire is occurring, someone has broken into the monitored space, etc.). In those implementations, the event may be one that has been identified, by computer-based logic (internal or external from the monitoring device) based on data collected by the monitoring device, as a potentially undesirable event.

Typically, the notifications (e.g., the primary notifications and the backup notification) are accessible from certain computer-based devices (e.g., smartphones or the like, laptops, computer tablets, etc.) that belong to either the people who live (work) at or have an ownership interest in the monitored space (they get the primary notifications for a monitored space) or people designated backup contacts for the monitored space (they get the backup notifications for the monitored space).

In a typical implementation, the information about the event may include a description of data relating to the event collected by the monitoring device. Moreover, in a typical implementation, the information about the event may include a video of the physical space during the event. In certain implementations, the information about the event can include one or more of the following: instructions on how to respond to the backup notification, a phone number for one or more of the people primarily associated with the physical space, a phone number for police, fire department and/or emergency medical services sufficiently proximate to the physical space to provide a timely response at the physical space, if needed, an address of the physical space, a map showing the location of the physical space on a map, and data associated with the physical space collected by from one or more of the plurality of sensors. One or more of the phone numbers is configured to appear on a touch sensitive screen associated with the computer-based device as a phone number that can be dialed automatically by touching the touch sensitive screen where the phone number appears.

According to some embodiments, the method includes enabling the person designated as a backup contact to indicate, after selecting the link to information about the event and viewing the information about the event, that, no further attention needs to be paid to the event. Moreover, in response to an indication from the person designated as a backup contact that no further attention needs to be paid to the event, the method may include sending an electronic communication over the computer-based network to notify one or more of the persons primarily associated with the physical space being monitored of the backup contact's indication. The method also may include sending an electronic communication over the computer-based network to the person designated as a backup contact (who provided the indication) confirming the backup contact's indication that no further attention needs to be paid to the event indicating (implicitly or explicitly) that the system will take no further steps to address the underlying event.

The system may enable the designation of a backup contact as such in any number of possible ways. In a typical example, the system enables the one or more of the persons primarily associated with the physical space being monitored to send out an invitation, over the computer-based network, to another person inviting that person to be a designated backup contact for the physical space being monitored.

The monitoring device can have any number of a variety of possible configurations. According to one such example, the monitoring device includes a housing, where the sensors are inside or coupled to the housing and include one or more of the following: a video camera, optionally with night vision capability, a microphone, a temperature sensor, a humidity sensor, an air quality sensor, a motion detector, a carbon monoxide sensor and an accelerometer. Each of these sensors typically provides information that enables the system to make the initial determination that an event has occurred in a physical space being monitored by the monitoring device.

In another aspect, a method includes receiving an indication that an event has occurred in a physical space being monitored by a monitoring device that includes a plurality of sensors, in response to the indication, preparing a first primary notification of the event, sending the first primary notification of the event over a computer-based network to each one of one or more persons primarily associated with the physical space being monitored, if, after a designated amount of time, none of the first primary notifications have been viewed by any of the persons primarily associated with the physical space being monitored, sending a second primary notification of the event over the computer-based network, via text, email, push notification, or some combination thereof, to one or more of the persons primarily associated with the physical space being monitored, and if, after a designated amount of time, none of the second primary notifications have been viewed or acknowledged by any of the persons primarily associated with the physical space being monitored, sending a backup notification of the event over the computer-based network to one or more persons designated as backup contacts.

In some implementations, sending the backup notification of the event includes sending a text, an email, a push notification, or some combination thereof to the one or more persons designated as backup contacts. The backup notification typically is logically associated with information that the one or more backup contacts can access about the event. Moreover, in some implementations, the backup notification has a link (e.g., a hyperlink or the like) to information about the event.

In yet another aspect, a computer-based system includes a monitoring device at a physical space to be monitored. The monitoring device has sensors and a communications module. A computer-based processing system is coupled to the monitoring device via a computer-based network. The computer-based processing system has a computer-based processor, a memory storage device, and a communications module. One or more computer-based devices (e.g., smartphones or other mobile computing devices, laptops, etc.) are coupled to the computer-based processing system via the computer-based network.

In a typical implementation, the computer-based processing system is configured to: receive an indication (e.g., from the monitoring device) that an event has occurred in the physical space being monitored by the monitoring device. In response to the indication, the computer-based processing system sends one or more primary notifications of the event over the computer-based network to each one of one or more persons primarily associated with (e.g., living in or having an ownership interest in) the physical space being monitored. If, after a designated amount of time (e.g., designated by the primary user, or factory pre-set), none of the primary notifications have been viewed (or otherwise acknowledged or acted upon) by any of the persons primarily associated with the physical space being monitored, the computer-based processing system sends a backup notification of the event over the computer-based network to each of one or more persons designated (e.g., by a primary user) as backup contacts. The backup notification typically has a link (e.g., a hyperlink or the like) to information (e.g., one or more video clips) about the event.

In still another aspect, a computer-based system includes a monitoring device at a physical space to be monitored. The monitoring device has sensors and a communications module. A computer-based processing system is coupled to the monitoring device via a computer-based network. The computer-based processing system has a computer-based processor, a memory storage device, and a communications module. One or more computer-based devices are coupled to the computer-based processing system via the computer-based network.

In a typical implementation, the computer-based processing device is configured to: receive an indication that an event has occurred in a physical space being monitored by the monitoring device, in response to the indication, prepare a first primary notification of the event, push, or otherwise send, the first primary notification of the event over the computer-based network to each one of one or more persons primarily associated with the physical space being monitored, if, after a designated amount of time, none of the first primary notifications have been viewed by (or acted upon by) any of the persons primarily associated with the physical space being monitored, send a second primary notification of the event over the computer-based network, via text, email, push notification or some combination thereof, to one or more of the persons primarily associated with the physical space being monitored, then, if, after a designated amount of time, none of the second primary notifications have been viewed or acknowledged by any of the persons primarily associated with the physical space being monitored, send a backup notification of the event over the computer-based network to one or more persons designated as backup contacts.

In yet another aspect, a non-transitory, computer-readable medium is disclosed that stores instructions executable by a computer-based processor to perform the steps of the techniques disclosed herein. In some implementations, one or more of the following advantages are present.

For example, the systems and functionalities disclosed herein facilitate automatic, intelligent, adequate and efficient allocation of resources to address potential security issues that may arise in a monitored space (e.g., a person's home or the like). Home owners are able to specifically designate friends or family members they consider to be trustworthy and responsible to help participate in keeping the person's home safe and secure. The system encourages community building, e.g., where one person may act as a backup contact for another and vice versa.

Other features and advantages will be apparent from the description and drawings, and from the claims.

BRIEF DESCRIPTION OF DRAWINGS

Like reference characters refer to like elements.

DETAILED DESCRIPTION

Figure 1:
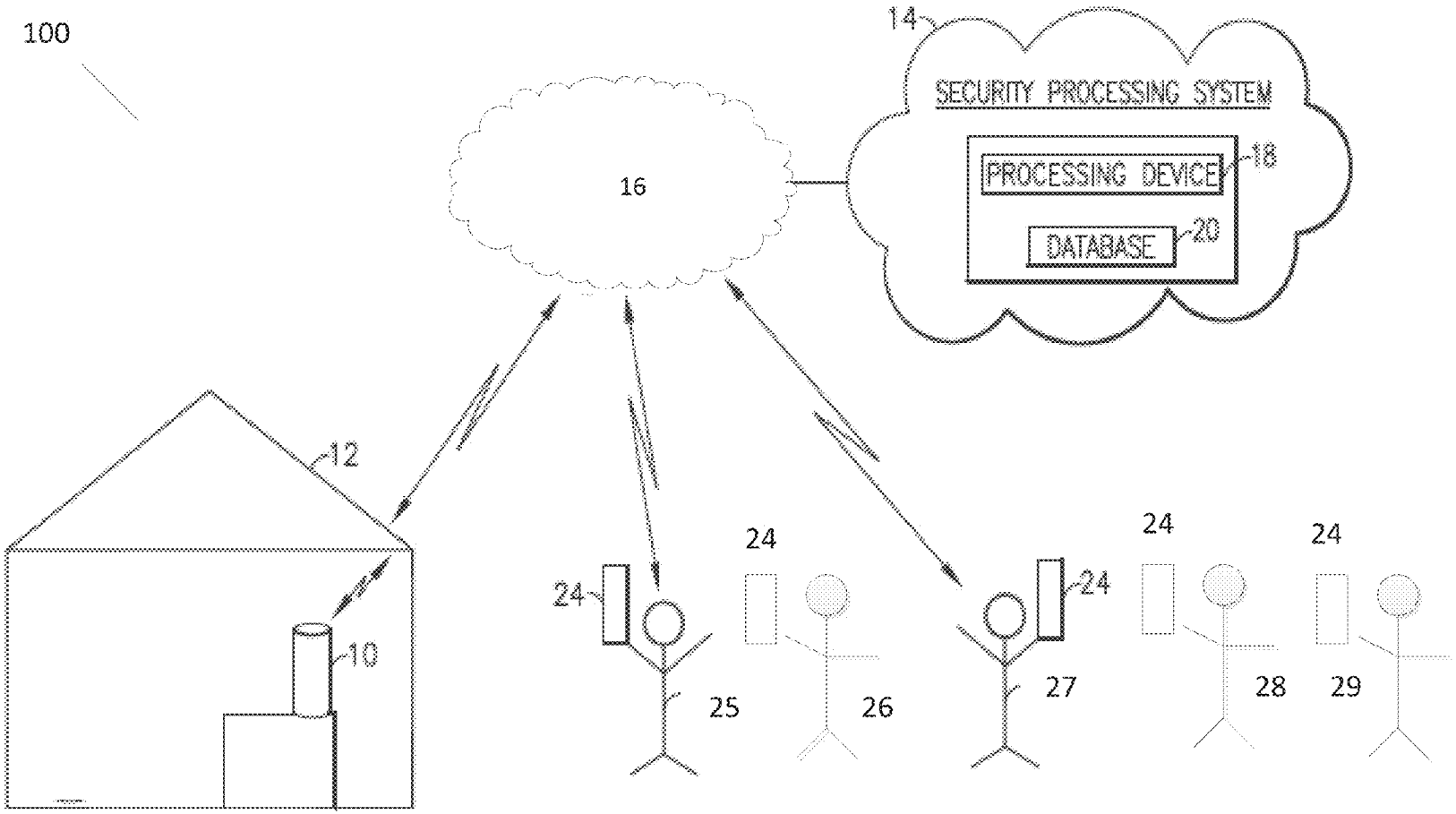
FIG. 1 is a schematic representation of an exemplary security/safety monitoring system.

FIG. 1 is a schematic representation of an exemplary security/safety monitoring system 100.

The illustrated system 100 includes a security/safety monitoring device 10 inside a house 12. More particularly, as shown, the monitoring device 10 is positioned to monitor a particular physical space inside the house.

In a typical implementation, the monitoring device 10 has a plurality of sensors (detectors) including, for example, one or more (or all) of the following: a video camera that may include a microphone (and/or that optionally includes night vision capability), a motion detector, a temperature sensor, a humidity sensor, an air quality sensor, a smoke detector, an accelerometer, etc. Moreover, in a typical implementation, the monitoring device 10 has a communications module that facilitates communicating with other system components (e.g., the computer-based processing system 14, one or more of the computer-based user interface devices 24 and/or other components not shown in FIG. 1). Additionally, in a typical implementation, the monitoring device 10 has an internal computer-based processor and memory storage capacity (e.g., a memory storage chip).

Each computer-based user interface device 24 provides a platform upon which the different users can interact with the system 100. In some implementations, the interactions are conducted via a web portal (e.g., a website) and one or more email accounts, or text numbers accessible by the users from their devices 24. In other implementations, the interactions are conducted via an app (i.e., a software application downloaded onto one or more of the devices). In some implementations, the system may facilitate a combination of these, and other, platforms upon which interactions may occur.

The interface may be configured to appear at a user's device in any one of a variety of possible configurations and include a wide variety of different information. For example, in some implementations, the interface may provide for system messaging (e.g., notifications, etc.). It may enable the users to access data about a monitored space (e.g., view videos, and see other data, etc.). The interface may be configured to present a timeline for each user that includes a time line of data (e.g., videos, etc.) captured and organized in a temporal manner. Other variations are possible as well.

A computer-based processing system 14 is coupled to the monitoring device 10 via a computer-based network (e.g., the Internet 16) and a plurality of computer-based user interface devices 24 are coupled to the computer-based processing system 14 via the computer-based network 16.

The computer-based processing system 14 has a computer-based processor 18 and a memory storage device configured to store a database 20. The computer-based processing system 14 also has a communications module that facilitates communicating with other system components.

The computer-based user interface devices 24 can be any kind of computer-based devices that a person might use to access information over a network (e.g., the Internet 16). In the illustrated example, the computer-based user interface devices 24 are smartphones. However, in other implementations, the computer-based user interface devices can include tablets, cell phones, laptop computers and/or desktop computers, etc.

Five smartphones 24 are shown in the illustrated example. Each smartphone 24 belongs to (or is primarily operated by) a corresponding one of the illustrated persons 25, 26, 27, 28 or 29. In the illustrated example, persons 25 and 26 live at and/or have an ownership interest in house 12 where the monitoring device 10 is located. In this way, persons 25 and 26 are said to be "primarily associated" with the physical space being monitored. In general, if the monitoring device 10 senses (or detects) data that suggests (or that the system 100 determines represents that) an unsafe or otherwise undesirable circumstance exists (or has come into being) in the space being monitored, then the system 100 first attempts to notify primary person 25 and/or primary person 26 at their respective smartphones 24.

None of the other people shown in FIG. 1 (i.e., 27, 28 or 29) live at or have an ownership interest in the house 12. Therefore, these other people 26, 27, 28 are not considered to be "primarily associated" with the physical space being monitored. However, in the illustrated example, each of them (27, 28 and 29) has been designated (by primary person 25, primary person 26 or both) as a backup contact for the monitoring system 100. These backup contacts may be friends or family members of the primary persons 25, 26. Thus, if the monitoring system 100 senses (or detects) data that suggests an unsafe or otherwise undesirable circumstance exists (or has come into being) in the space being monitored, but cannot confirm that any of the primary people has received (or acted upon) a notification from the system 100 about the undesirable circumstance, then the system 100 attempts to notify one or more of the backup contacts 27, 28 or 29 via their respective smartphones.

In a typical implementation, the system 100 is able to be operated in any one of several different operating modes. For example, according to one implementation, the system 100 has three different operating modes: armed mode, in which the disarmed mode, and privacy mode.

In armed mode, the monitoring device 10 is powered on. Typically, in armed mode, the camera of the monitoring device is armed and enabled and the microphone of the monitoring device is armed and enabled. Moreover, the monitoring device 10 is looking for motion. In a typical implementation, upon detecting motion (or at least certain types of motion), the monitoring device starts uploading video data to the cloud service (e.g., security processing system 114) and sends push notification(s), or other communications, to one or more (or all) of the primary users, and/or backup contacts, associated with the monitored location where the motion has been detected with a call to action for those users to view the detected motion via the app or website. Any uploaded videos may be saved to a person's timeline.

In disarmed mode, the system acts in a manner very similar to the way the system acts in armed mode, one of the most notable differences being that, in disarmed mode, no notifications are sent to any of the users.

In privacy mode, the monitoring device 10 is powered on. However, it is generally not monitoring or recording any information about the space where it is located. In privacy mode, the camera is off and any listening devices (e.g., a microphone, etc.) are off; no video or audio is being recorded, and no users are able to remotely view the space where the monitoring device 10 is located. Moreover, when the system 100 is in privacy mode, if a user accesses the system (e.g., through an app on their smartphone, or at a web-based portal), the "watch live" functionality that ordinarily would allow the user to see the monitored space is not available.

In typical implementations, the operating modes may be controlled by a user through a software app and a user (e.g., a primary user associated with a monitored location) may switch the system between operating modes by interacting on the app.

Figure 2:
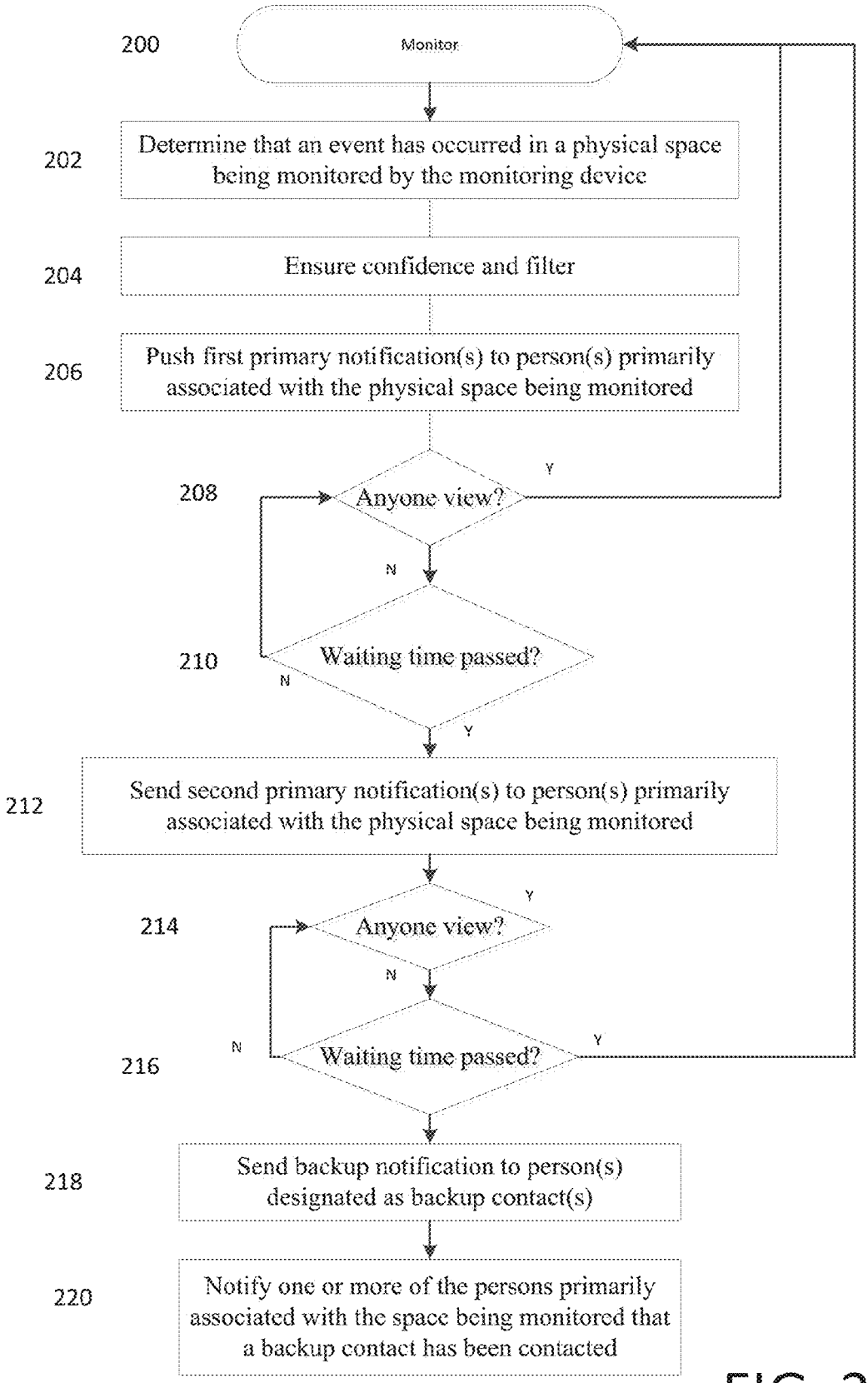
FIG. 2 is a flowchart showing an exemplary implementation of a process that may be performed, for example, by the monitoring system in FIG. 1.

FIG. 2 is a flowchart showing an exemplary implementation of a process that may be performed, for example, by the monitoring system 100 in FIG. 1. In a typical implementation, the process represented in the exemplary flowchart would be available when the system is operating in armed mode. In some implementations, the process may be available in other modes as well.

According to the illustrated flowchart, the exemplary process begins with the monitoring device 10 simply monitoring the physical space (e.g., inside the house 14 in FIG. 1).

Monitoring can include any variety of activities, but, in a typical implementation, monitoring would include collecting data about the environment in the monitored space that might indicate an undesirable situation (e.g., a fire or an unlawful break-in). The data may be collected by one or more (or all) of the following sensors in the monitoring device: a video camera that may include a microphone (and/or that optionally includes night vision capability), a motion detector, a temperature sensor, a humidity sensor, an air quality sensor, a smoke detector, or an accelerometer.

Moreover, in a typical implementation, monitoring may include the system 100 making an initial determination (e.g., with the computer-based processor in the monitoring device) as to whether the data collected by the one or more sensor likely represents an unsafe or otherwise undesirable situation at the monitored location.

At 202, the system 100 determines that an unsafe or otherwise undesirable event may have occurred in the physical space being monitored by the monitoring device. As used herein, the term event should be construed broadly to include any kind of occurrence that might be considered unsafe or otherwise undesirable. Examples of unsafe or otherwise undesirable events might include a fire, a break-in by a burglar, etc.

In a typical implementation, the indication that an event has occurred is determined based on the data that is collected by the monitoring device. The data used to make that determination can include virtually any kind of data that may be relevant to whether the monitored space is safe and/or secure. Examples include a video clip (e.g., with an audio portion) of the monitored space, temperature data, humidity data, motion detection data, etc. Moreover, in a typical implementation, one or more computer-based processors (e.g., inside the monitoring device 10 and/or at the remotely-located computer-processing system 14) make the determination that an event has occurred by processing data collected by the monitoring device 10.

There are a variety of ways to make the determination, based on sensor data from the monitoring device, that an unsafe or otherwise undesirable event may have occurred in the physical space being monitored. The determination need not be absolutely certain; in a typical implementation, if the data suggests that an unsafe or otherwise undesirable event has occurred, then, in some instances, that may be sufficient to make a determination that an event may have occurred. For example, if the data from the monitoring device 10 shows a somewhat rapid rise in temperature over time (suggesting the possibility of a fire, for example), then the monitoring system 100 may determine that an unsafe or otherwise undesirable event (in this case, a fire) may be occurring, even though the rise in temperature could be attributable to causes other than a fire. In another example, if the data from the monitoring device 10 shows that motion has been detected in the monitored space during a time of day that motion is not usually detected, then the monitoring system 100 may determine that an unsafe or otherwise undesirable event (in this case, a possible break-in) may be occurring, even though the unexpected motion could be attributable to causes other than a break-in.

In a typical implementation, after it has been determined that an event may have occurred, the system 100 prepares a first primary notification of the event. The first primary notification is intended to be a first notification to be sent (e.g., from the security processing system 14) to one or more of the primary people for the monitored space (e.g., 25 and 26 in FIG. 1). In a typical implementation, the first primary notification is prepared at the computer-based processing device 14. Moreover, in a typical implementation, the first primary notification is made accessible from one or more (or all) of the computer-based devices associated with the primary people for the monitored space.

After preparing the first primary notification, but before sending it, the system 100 may optionally wait (at 204) for some period of time (e.g., less than a minute or so). During this period of time, the system 100 may attempt to check/ensure confidence in its determination.

Then, according to the illustrated example, the system 100 (e.g., the computer-based processing system 14) pushes, or otherwise makes available, the first primary notification (at 206) to the computer-based user device(s) 24 associated with one or more of the persons primarily associated with the monitored space (e.g., 25 and 26 in FIG. 1). In general, a push notification is an electronic communication initiated by the publisher and not in response to a specific request from the receiver. Push notifications may appear at the respective devices via an app.

The system 100 then waits (at 208, 210) for a designated amount of time for an indication that the first primary notification has been viewed/acknowledged from any of the computer-based user devices 24. The designated amount of waiting time can vary. In one example, the designated waiting time is 5 minutes. However, in various implementations, the designated waiting time can be, for example, between 4 minutes and 6 minutes, between 3 minutes and 7 minutes, or any other amount of time that is sensible given the urgency of whatever event is believed to possibly exist in the monitored space. Moreover, in various implementations, the amount of time that a system may wait is a value that can be specified by one or more of the primary persons associated with the monitored space.

In some implementations, the first primary notification is not considered to have been viewed/acknowledged until the system receives an indication from one of the contacts that "everything is okay" or that appropriate emergency personnel (e.g., police, fire, medical, etc.) have been contacted. If, within the designated amount of time, the system 100 receives an indication (at 208) that the first primary notification has been viewed (or acknowledged), the system 100 (e.g., the computer-based processing system 14) simply returns to monitoring the physical space (at 201) and the event that triggered the first primary notification is considered to have been resolved.

In some implementations, the system presents to each primary user a button labeled "everything is okay" or something similar that the person can touch on the screen of his or her smartphone or other mobile device to indicate that everything is okay and/or that appropriate emergency personnel (e.g., police, fire, medical, etc.) have been contacted. In other implementations, no such button is presented to the contacts. Instead, in those implementations, acknowledgement is determined by one or more of the primary location members viewing the event or opening a push notification. A primary location member is generally a person who resides at the location being monitored. This is considered a passive acknowledgement and will stop escalation (i.e., transmittal of a message to other people).

The first primary notification can include a variety of information (or access to a variety of information) about the corresponding event. In some implementations, for example, the first primary notification(s) include just a simple message (e.g., "Motion detected in the living room at Brooklyn Apartment"). In other implementations, the first primary notification can include other information (or links to other information), such as a video of the monitored space showing the detected motion, etc.

If the system 100 does not receive an indication that the first primary notification has been viewed (or acknowledged) and the designated amount of waiting time has passed, then the system 100, according to the illustrated example, sends (at 212) a second primary notification. The second primary notification is also sent to the person(s) primarily associated with the physical space being monitored. However, the second primary notification may be sent via a different medium than the first primary notification. For example, if the first primary notification was sent as a push notification, the second primary notification might be sent via email and text to the persons primarily associated with the monitored space (i.e., 25, 26).

In some implementations, the system is configured to enable users to choose which media will be used for transmitting various notifications (e.g., the first primary notification and the second primary notification). In those implementations, a user may choose a first medium (e.g., email or text) for any first primary notifications that the system produces and a second medium (e.g., push notification) for any second primary notifications that the system produces. The different users can customize system interactions in that way. The system also may enable the users to specify what media should be used to interact with the designated backup contacts. The system 100 then waits (at 214, 216) for a designated amount of time for an indication that the second primary notification has been viewed (or acknowledged), e.g., from any of the computer-based user devices 24. The designated amount of waiting time can vary. In one example, the designated waiting time is 5 minutes. However, in various implementations, the designated waiting time can be, for example, between 4 minutes and 6 minutes, between 3 minutes and 7 minutes, or any other amount of time that is sensible given the urgency of whatever event is believed to possibly exist in the monitored space. Again, in various implementations, the amount of time that a system may wait is a value that can be specified by one or more of the primary persons associated with the monitored space.

If, within the designated amount of time, the system 100 receives an indication (at 214) that the second primary notification has been viewed (or acknowledged or otherwise acted upon), the system 100 (e.g., the computer-based processing system 14) simply returns to monitoring the physical space (at 201) and the event that triggered the first and second primary notification is considered to have been resolved.

The second primary notification can include a variety of information (or access to a variety of information) about the corresponding event. In some implementations, for example, the second primary notification(s) include just a simple message (e.g., "Motion detected in the living room at Brooklyn Apartment"). In other implementations, the second primary notification can include other information (or links to other information), such as a video of the monitored space showing the detected motion, etc.

If the system 100 does not receive an indication that the second primary notification has been viewed (or acknowledged) and the designated amount of waiting time has passed, then the system 100, according to the illustrated example, sends (at 218) a backup notification to one or more of the designated backup persons for the monitored space.

The backup notification can be sent in a variety of ways. In one implementation, the backup notification is sent to the backup contacts (i.e., 27, 28 and 29 in FIG. 1) via email and/or text. In some implementations, the backup notification can be sent via push technology as well.

The backup notification can include a variety of information (or access to a variety of information) about the corresponding event. In some implementations, for example, the backup notification includes just a simple message (e.g., "Motion detected in the living room at Brooklyn Apartment"). In other implementations, the backup notification can include other information (or links to other information), such as a video of the monitored space showing the detected motion, etc.

In a typical implementation, the backup notification includes a link (e.g., a hyperlink) that the backup contact can select to navigate somewhere else (e.g., to a webpage, a mobile application, or the like) that includes information about the event. For example, if a particular backup contact is a registered user of the system (and has downloaded an app that facilitates interactions with the system), the system may opt to send that backup contact a backup notification in push notification format (e.g., with a payload or the like). In that instance the backup contact may navigate to a mobile application (e.g., by clicking on a link in the push notification) to view information about the event. In various implementations, the link in the backup notification may lead to a web page, or web app, or mobile app.

The information about the event on the webpage, in the app, etc. can include a variety of different information. However, in a typical implementation, the information will include types of information that will help the backup contact assess whether the event actually warrants any kind of intervention, and to help the backup contact easily provide or facilitate whatever intervention may be warranted. For example, in one embodiment, the webpage or app, etc. will include: a video of monitored space, a listing of recent events in the monitored space, written instructions/suggestions on how to respond, a listing of persons primarily associated with the monitored space and their contact info (e.g., phone numbers, email addresses, or the like), a listing of emergency contacts local to the monitored space (e.g., police department, fire department, emergency medical services, etc.) with their respective phone numbers, a web map showing the location of the monitored space (with optional functionality to obtain directions through the web map), the address where the monitored space is located, and/or other data from the monitoring device (e.g., temperature, humidity, air quality, etc.) that may be relevant to assessing the nature and severity of a given event.

In a typical implementation, the phone numbers may be presented to the backup contacts in such a manner that, if a backup contact is viewing the webpage from a smartphone or the like, then the backup contact can simply touch the number on the screen to dial.

Also, in a typical implementation, the webpage includes a button that the backup contact can select to indicate, "Everything looks okay" or the like. In a typical implementation, if one of the backup contacts selects "everything looks okay" on the website, the system 100 considers the event to be resolved and continues to monitor the space. In some implementations, no such button is presented to the backup contacts. Instead, in those implementations, the system 100 may be adapted to consider a particular event to have been resolved in response to receiving (e.g., at the security processing system 14) an indication that one of the backup contacts has viewed an associated communication and/or the underlying data. This is considered a type of passive acknowledgement scheme.

According to the illustrated method, after sending the backup notification, the system 100 notifies (at 220) one or more of the persons primarily associated with the monitored space that a backup notification has been sent.

Moreover, in a typical implementation, if one of the backup contacts selects the "everything looks okay" button—or otherwise indicates (actively or passively) that the monitored space is fine, then the system notifies one or more of the persons primarily associated with the monitored space that the backup contact has essentially concluded that "everything looks okay."

In some implementations, once any of the contacts (e.g., a primary contact or a backup contact, etc.) has indicated that "everything looks okay," then the system notifies one or more (or all) of the contacts that this has happened.

Figure 3:
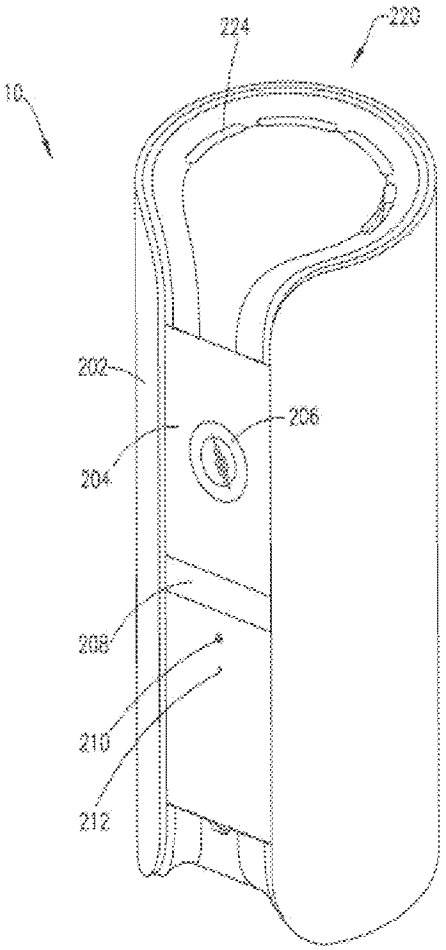
FIG. 3 is a perspective view of an exemplary security/safety monitoring device.

FIG. 3 is a perspective view of an exemplary security/safety monitoring device 10.

The illustrated device 10 has an outer housing 202 and a front plate 204. In this example, the front plate 204 defines a first window 206, which is in front of an image sensor (e.g., a video camera). A second window 208, which is rectangular in this example, is in front of an infrared LED array. An opening 210 is in front of an ambient light detector, and an opening 212 is in front of a microphone. The front plate 204 may be a black acrylic plastic, for example. The black plastic acrylic plastic in some implementations would be transparent to near IR greater than 800 nm.

The top 220 of the device 10 is also shown. The top 220 includes outlet vents 224 through the top to allow for airflow out of the device 10. In a typical implementation, the bottom of the device includes inlet vents to allow airflow into the device 10. The top 220 and the bottom of the device 10 may be separate, plastic pieces that are attached to the housing 202 or an internal housing during assembly, for example. During operation, air passing through the bottom, inlet vents travels through the device 10, where it picks up heat from the internal components of the device, and exits through the top, outlet vents 224. In this example hot air rises through the device 10, causing air to be drawn into the device from the bottom vents and to exit out of the top vents 224. A fan may be provided to draw external air into the device 10 through the bottom, inlet vents and/or to drive the air out of the device through the top, outlet vents 224.

In general, the size of the vents 224 should be large enough to allow heat to flow out of the unit, but the vents should not be so large that a child or person would be able to stick a finger into the unit. In some implementations, a larger vent is provided, but is covered with a Gore-Tex, nylon or other type of mesh material to prevent water ingress but allow air to exit the unit.

In a typical implementation, the device 10 shown in FIG. 3 includes circuitry, internal components and/or software to perform and/or facilitate the functionalities disclosed herein.

Figure 4:
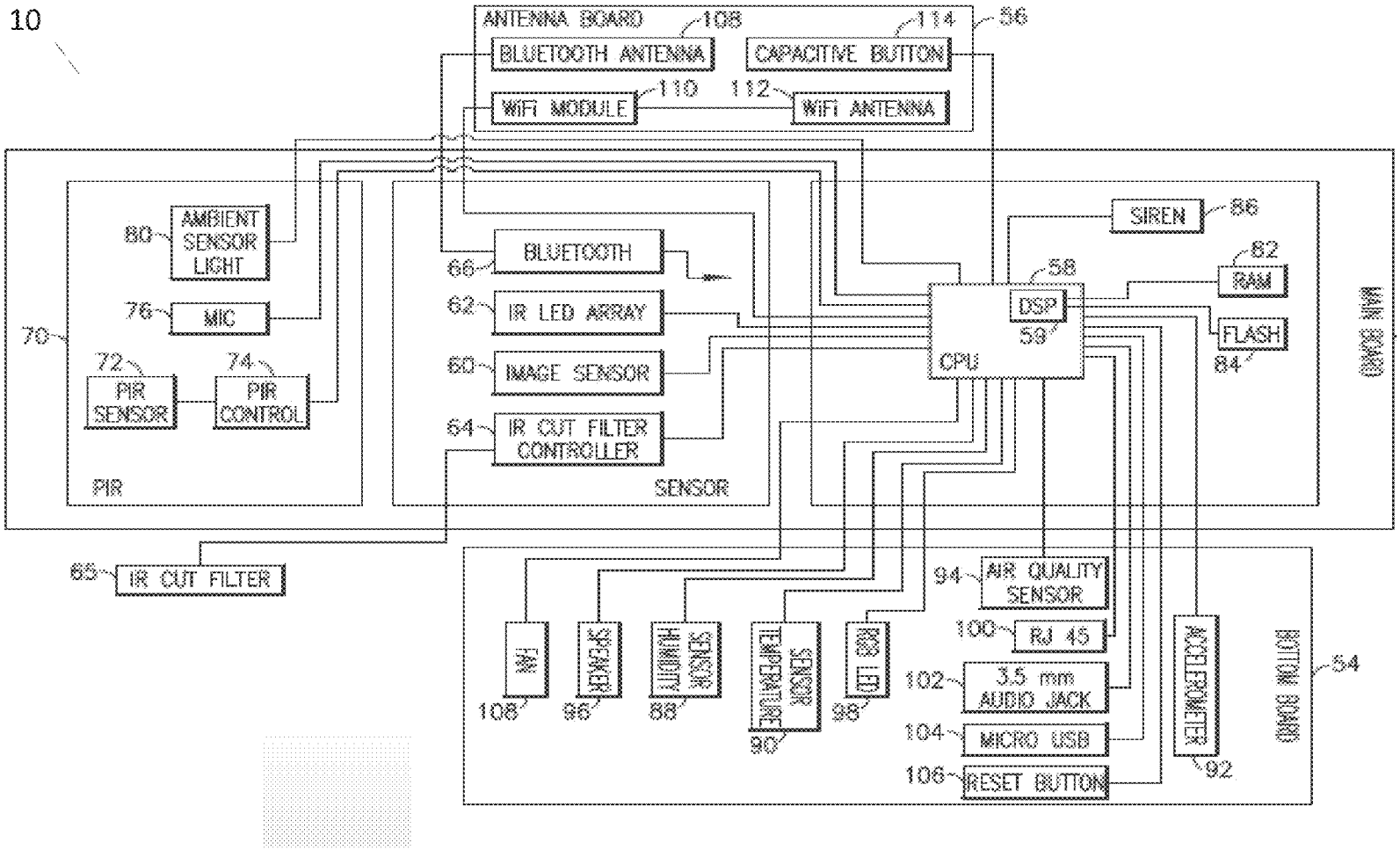
FIG. 4 is a schematic representation of one example of the internal components in an exemplary monitoring device.

An example of the internal components, etc. in one implementation of the device 10 is shown in FIG. 4.

In FIG. 4, the illustrated device 10 has a main printed circuit board ("PCB"), a bottom printed circuit board 54, and an antenna printed circuit board 56. A processing device 58 (e.g., a central processing unit ("CPU")), is mounted to the main PCB. The processing device may include a digital signal processor ("DSP") 59. The CPU 58 may be an Ambarella digital signal processor, A5x, available from Ambarella, Inc., Santa Clara, Calif., for example.

An image sensor 60 of a camera (e.g., capable of acquiring video), an infrared light emitting diode ("IR LED") array 62, an IR cut filter control mechanism 64 (for an IR cut filter 65), and a Bluetooth chip 66 are mounted to a sensor portion of the main board, and provide input to and/or receive input from the processing device 58. The main board also includes a passive IR ("PIR") portion 70. Mounted to the passive IR portion 70 are a PIR sensor 72, a PIR controller, such as a microcontroller, 74, a microphone 76, and an ambient light sensor 80. Memory, such as random access memory ("RAM") 82 and flash memory 84 may also be mounted to the main board. A siren 86 may also be mounted to the main board. In some implementations, certain components (e.g., the PIR sensor 72 and the PIR controller) may be omitted.

A humidity sensor 88, a temperature sensor 90 (which may be combined into a combined humidity/temperature sensor), an accelerometer 92, and an air quality sensor 94, are mounted to the bottom board 54. A speaker 96, a red/green/blue ("RGB") LED 98, an RJ45 or other such Ethernet port 100, a 3.5 mm audio jack 102, a micro USB port 104, and a reset button 106 are also mounted to the bottom board 54. A fan 108 is also provided.

A Bluetooth antenna 108, a WiFi module 110, a WiFi antenna 112, and a capacitive button 114 are mounted to the antenna board 56.

The components may be mounted to different boards. For example, the Wifi module 110 may be mounted to the main board 52.

In general, the monitoring device 10 represented by FIGS. 3 and 4 is operable to acquire data about the physical space where the monitoring device 10 is located and communicate (e.g., using the communications module(s) at 56 or other communications modules) with other system components to support the functionalities disclosed herein. In some implementations, the processor 58 is configured to perform at least some of the processing described herein. In some implementations, the processing device 18 (at the remotely-located computer-based processing system 14) is configured to perform at least some of the processing described herein. In a typical implementation, processor 58 and processor 18 work in conjunction to perform the processing described herein.

Other exemplary monitoring devices and/or environments in which the systems, techniques and components described herein can be incorporated, deployed and/or implemented are disclosed in pending U.S. patent application Ser. No. 14/260,264, entitled System and Methods for Designating and Notifying Secondary Users for Location-Based Monitoring, which is incorporated herein by reference.

Figure 5:
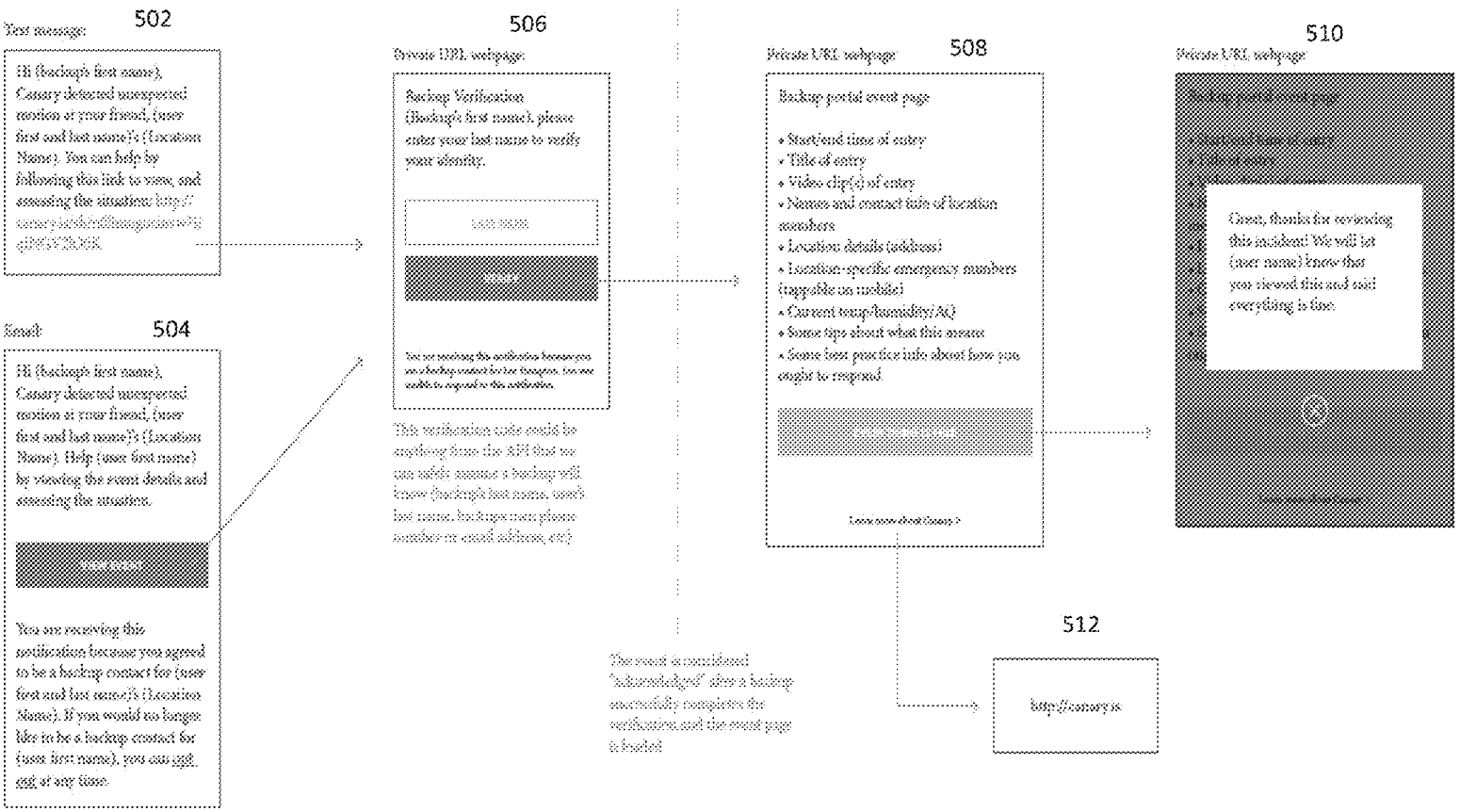
FIG. 5 is a schematic representation showing an exemplary sequence of communications between a computer-based processing system and one of the backup contacts for a monitored space, with the backup contact utilizing his or her mobile device, for example.

FIG. 5 is a schematic representation showing an exemplary sequence of communications between a computer-based processing system (e.g., 14 in FIG. 1) and one of the backup contacts (e.g., 27 in FIG. 1) for a monitored space.

According to the illustrated sequence, the system 100 sends a text 502 and email 504 to the backup contact. Each of these messages indicates that "Canary" has detected unexpected motion at the backup contact's friend's home. "Canary," as used in this context refers, for example, to the exemplary system 100 in FIG. 1. The text and email may be viewable by the backup contact on any of his or her computer-based user devices 24. Although text messages and emails are disclosed herein as examples of suitable communications for conveying information to/from primary and backup contacts, various implementations may utilize different types of communications to convey such information. For example, in some implementations, some or all of the communications may occur through a software application (e.g., an app of the type that might be downloaded to a smartphone or the like).

The text 502 includes a hyperlink and the email includes a button (also a type of link), the selection of either brings the backup contact to a webpage that asks the backup contact to verify his or her identity.

Other techniques for initial communications to a backup contact about a particular event are possible as well. For example, one or more of the initial communications may be a push notification to backup contacts. If a backup contact is a registered system user, then the backup contact would go into the app (by selecting a link or button in the push notification) as an already authenticated registered user and see the information from the location to which they are a backup contact. Moreover, in some implementations, only one (or more than two) communications may be sent to one or more (or all) of the backup contacts.

In the illustrated example, after selecting the hyperlink in the text 502 or the button in the email 504, the system presents to the backup contact (at his or her computer-based device 24) a private URL backup contact verification webpage 506 (in some implementations this may be a screen in an app). On this backup contact verification page 506, the system 100 prompts the backup contact to verify his or her identity (e.g., by entering his or her last name). There are, of course, numerous other ways that the backup contact could verify his or her identity. A few examples include, entering his or her phone number, first name, answering a specific question, for example, "what was the name of your favorite teacher" etc. As indicated in the figure, the verification code could be anything from the API that can safely be assumed that a backup contact would know (e.g., the backup's last name, user's last name, backup's own phone number or email address, etc.).

In the illustrated implementation, the system considers the event to have been "acknowledged" after the backup contact has successfully completely verification and the event page 508 is loaded. This is not always the case, however, and in some instances, the system 100 requires the backup contact to explicitly indicate that everything is fine (e.g., by pressing the button (link) on the event page labelled "everything is fine" or taking some other explicit step like this) before the system 100 will treat the event as having been resolved.

After verifying the backup contact, the system presents a webpage (the event page 508) to the backup contact with various information about the event. A listing of some of the different types of information that may be presented to the backup contact is shown in the figure. According to the illustrated example, the information includes a start and end time associated with the entry, a title of the entry, one or more video clips associated with the entry, the names and contact information of primary users associated with the monitored location, location details (e.g., address or the like), location-specific emergency numbers (e.g., local fire department, local police department, etc.) in a format that enables dialing by tapping the number on a touch sensitive screen, current temperature, humidity, air quality, some tips about what the event means or might mean, and some best practices about how the backup contact might respond. Other types of information and any combination of this or other information about the event may be presented to the backup contact at that point.

The event webpage 508 includes an "Everything is Fine" button (different implementations may include variations of the "everything is fine" button) that the backup contact can select to indicate to the system 100 essentially that the backup contact has considered the information provided in the event page 508 and determined that everything is fine and that no further attention needs to be paid to the event.

If the backup contact selects the "Everything is Fine" button, then the system 100 presents a message to the backup contact (at 510) on his or her user device 24 essentially confirming the backup contact's indication in this regard. An example of this kind of message is shown in the figure.

The event webpage 508 in the illustrated implementation also includes a "Learn more about Canary" link, the selection of which will bring the backup contact to a webpage 512, for example, with information about the overall system 100 and/or its various functionalities.

Figure 6:
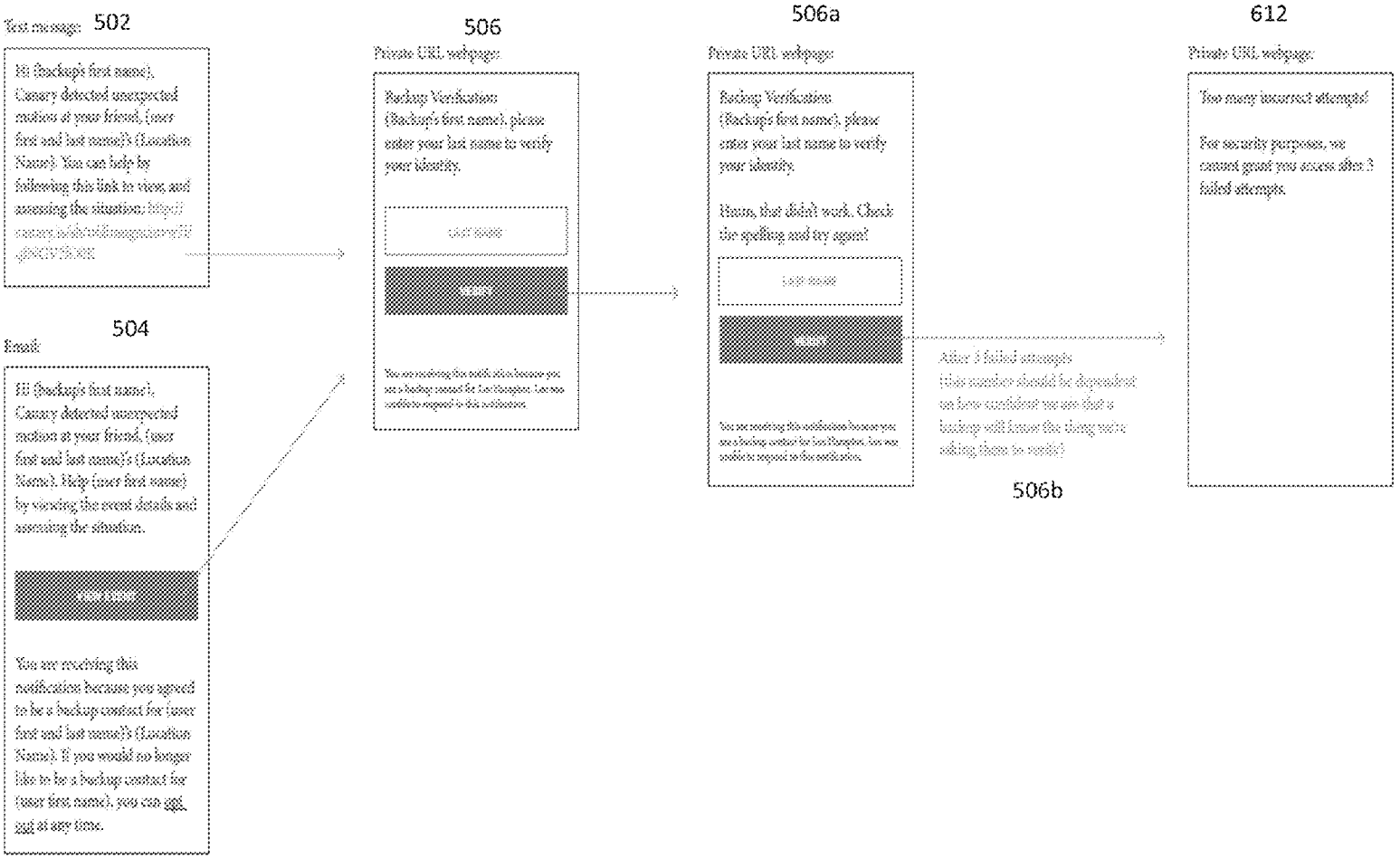
FIG. 6 is a schematic representation showing an exemplary sequence of communications between a computer-based processing system and one of the backup contacts for a monitored space, with the backup contact utilizing his or her mobile device, for example.

FIG. 6 is a schematic representation showing an exemplary sequence of communications between a computer-based processing system (e.g., 14 in FIG. 1) and one of the backup contacts (e.g., 27 in FIG. 1).

The illustrated example is similar in some ways to the sequence represented in FIG. 5. In the illustrated example in FIG. 6, however, the backup contact fails to properly verify his or her identity to the system. After the first two failed attempts (at 506 and 506*a*), the system 100 prompts the user to try again. After the third failed attempt (see 506*b*), according to the illustrated example, the system 100 (at 612) informs the backup contact that he or she cannot get access to additional information about the event. Other implementations may provide for more than three attempts or less than three attempts. Moreover, other implementations, may handle a single failed attempt by offering the backup contact other ways to verify his or her identity. Other variations are possible in this regard as well.

FIGS. 7A-7G show a series of exemplary screenshots that the system causes to be presented at one or more of the user devices (e.g., 24) in response to an event.

Figure 7C:
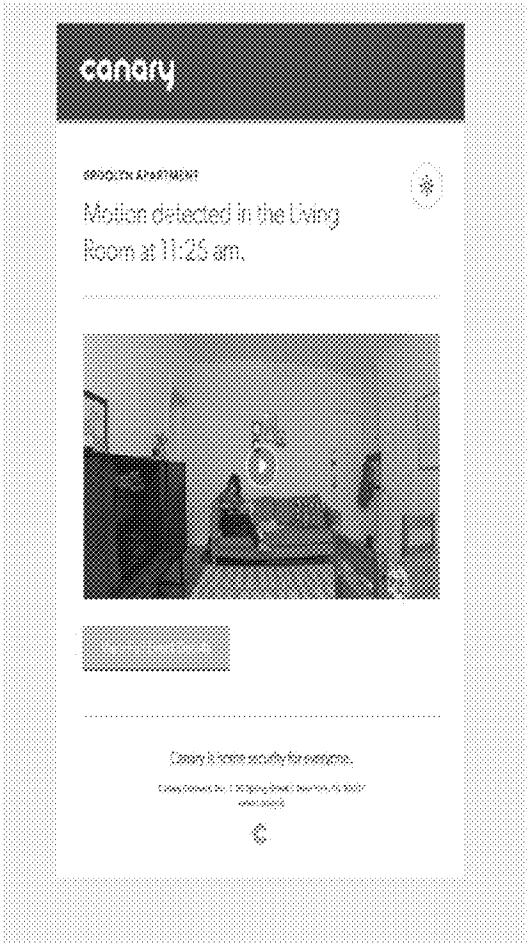
FIGS. 7B and 7C respectively show an exemplary text message and an exemplary email that the system, in one implementation, sends to one or more of the persons primarily associated with the monitored space if the system does not receive any indication that the push notification has been viewed.
Figure 7B:
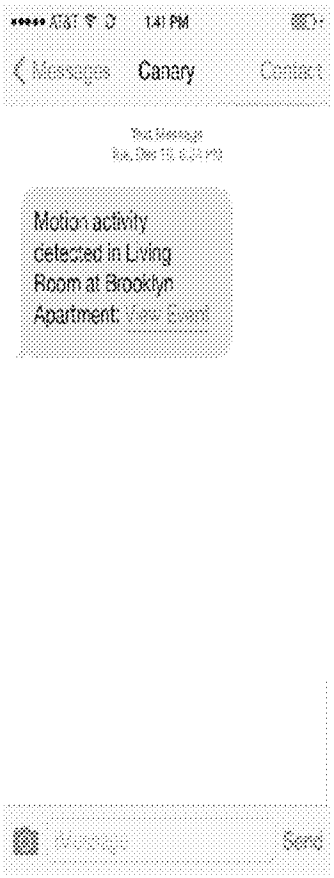
Figure 7A:
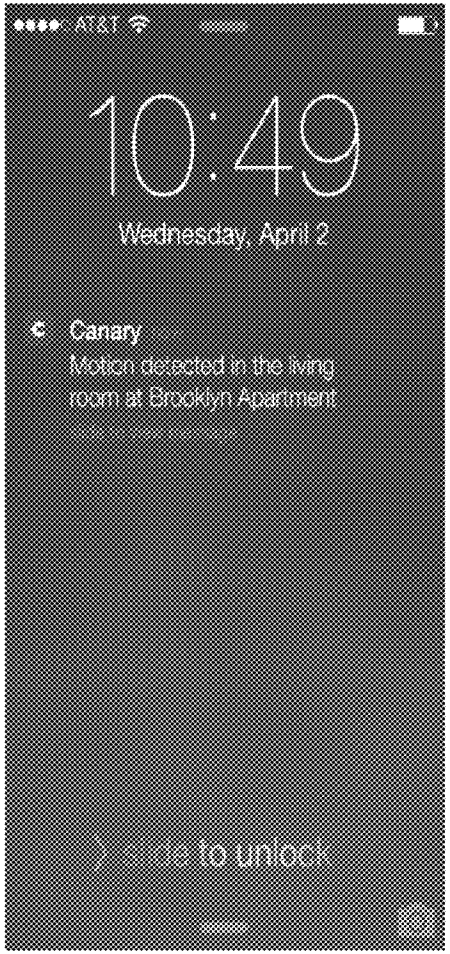
FIG. 7A shows an example of a push notification that, in some implementations, the system displays in response to a detected event to one or more of the persons primarily associated with the monitored space.

FIG. 7A shows an example of a push notification that, in some implementations, the system displays in response to a detected event to one or more of the persons primarily associated with the monitored space. In a typical implementation, the person would slide to unlock the device represented in the figure and interact with the push notification to access more information (e.g., an event page) about the underlying event.

FIGS. 7B and 7C respectively show an exemplary text message (FIG. 7B) and an exemplary email (FIG. 7C) that the system, in one implementation, sends to one or more of the persons primarily associated with the monitored space if the system does not receive any indication that the push notification has been viewed.

In the exemplary text message of FIG. 7B, a person would click the "View Event" link to access additional information (e.g., an event page) about the underlying event.

In the exemplary email of FIG. 7C, a person would click the "view full event details" button (link) to access additional information (e.g., an event page) about the underlying event.

Figure 7E:
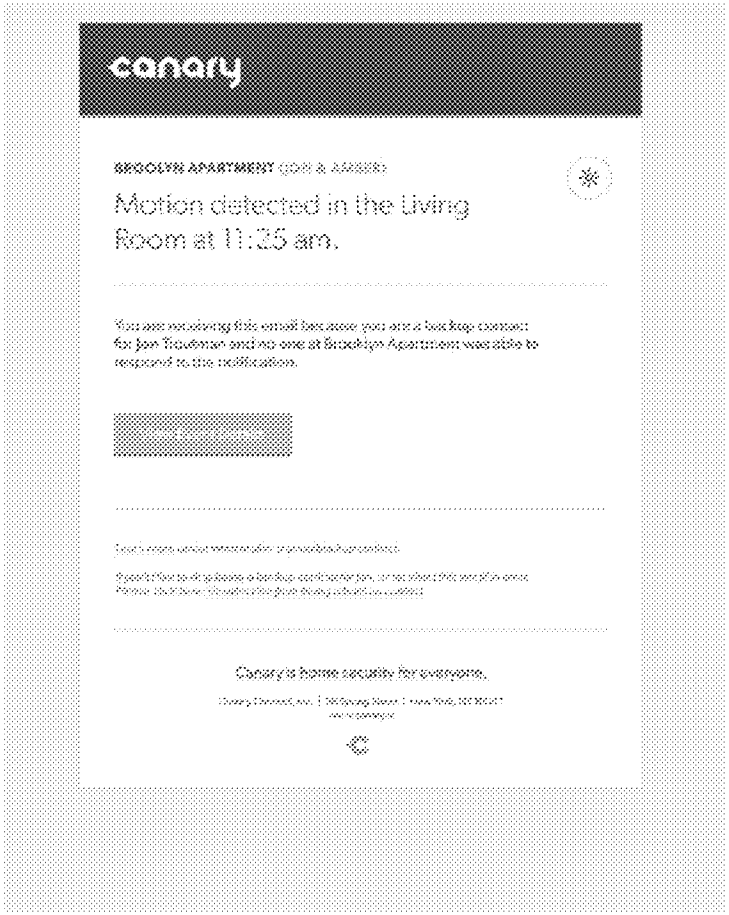
FIGS. 7D and 7E respectively show an exemplary text message and an exemplary email that the system, in one implementation, sends to one or more of the backup contacts associated with the monitored space if the system does not receive any indication that either the text(s) or email(s) in FIGS. 7B and 7C has been viewed.
Figure 7D:
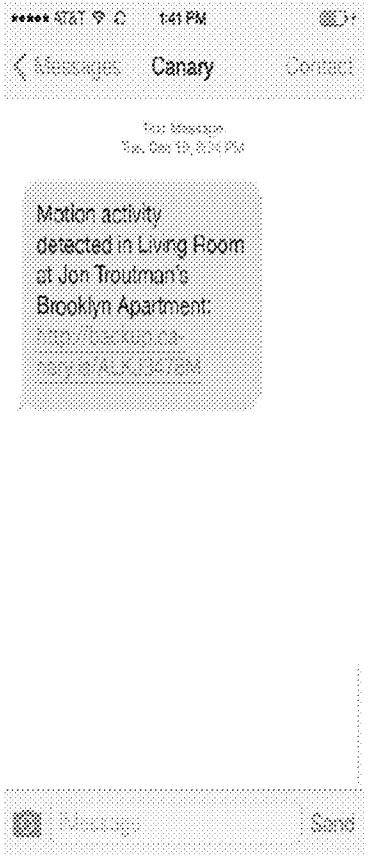

FIGS. 7D and 7E, respectively, show an exemplary text message (FIG. 7D) and an exemplary email (FIG. 7E) that the system, in one implementation, sends to one or more of the backup contacts associated with the monitored space if the system does not receive any indication that either the text(s) or email(s) in FIGS. 7B and 7C has been viewed.

In the exemplary text message of FIG. 7D, a person would click the hyperlink in the message to access additional information (e.g., an event page) about the underlying event.

In the exemplary email of FIG. 7E, a person would click the "view event details" button (link) to access additional information (e.g., an event page) about the underlying event.

Figure 7F:
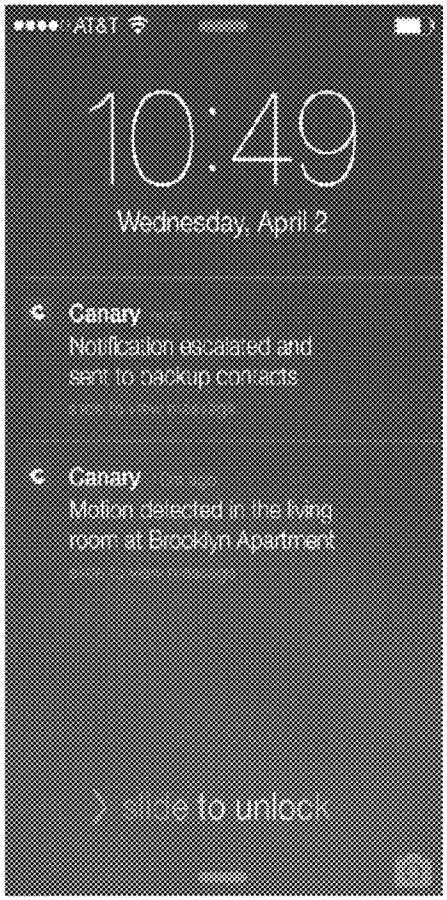
FIG. 7F shows an example of a push notification that the system, in one implementation, displays to one or more of the persons primarily associated with the monitored space that the system has communicated with one or more backup contacts with regard to the event.

FIG. 7F shows a series of exemplary push notifications that the system 100 might sent to a non-responsive primary user. The illustrated implementation includes two push notifications, the first indicating "Motion detected in the living room at Brooklyn apartment," the second (10 minutes later) indicating "Notification escalated and sent to backup contacts" to indicate that the system has communicated with one or more backup contacts with regard to the event.

Figure 7G:
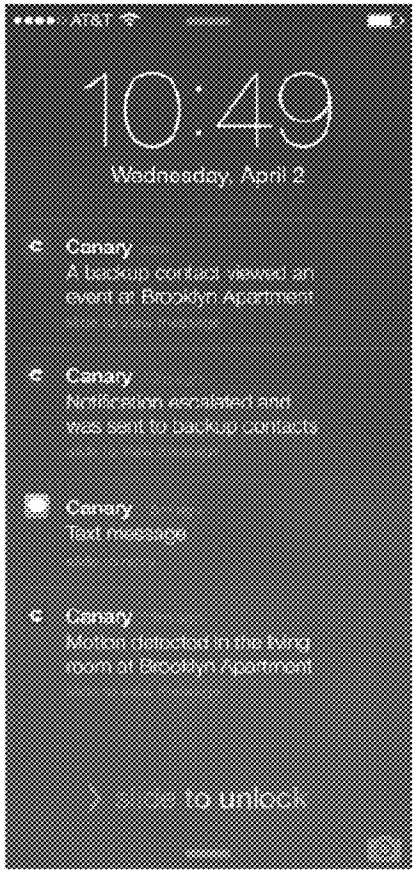
FIG. 7G shows an example of a push notification to notify one or more of the persons primarily associated with the monitored space that a backup contact has viewed a webpage, for example, with detailed information about an event.

If one of the backup contacts views the webpage with detailed information about the event, then, in one implementation, the system marks the event as acknowledged and sends a push notification to notify one or more of the persons primarily associated with the monitored space that this has occurred. An example of this kind of push notification is shown in FIG. 7G.

In a typical implementation, the backup contact functionality described herein can be enabled (so that the system implements the techniques related to backup contacts described herein) or disabled (so that the system does not implement the techniques related to backup contacts described herein).

Figure 8A:
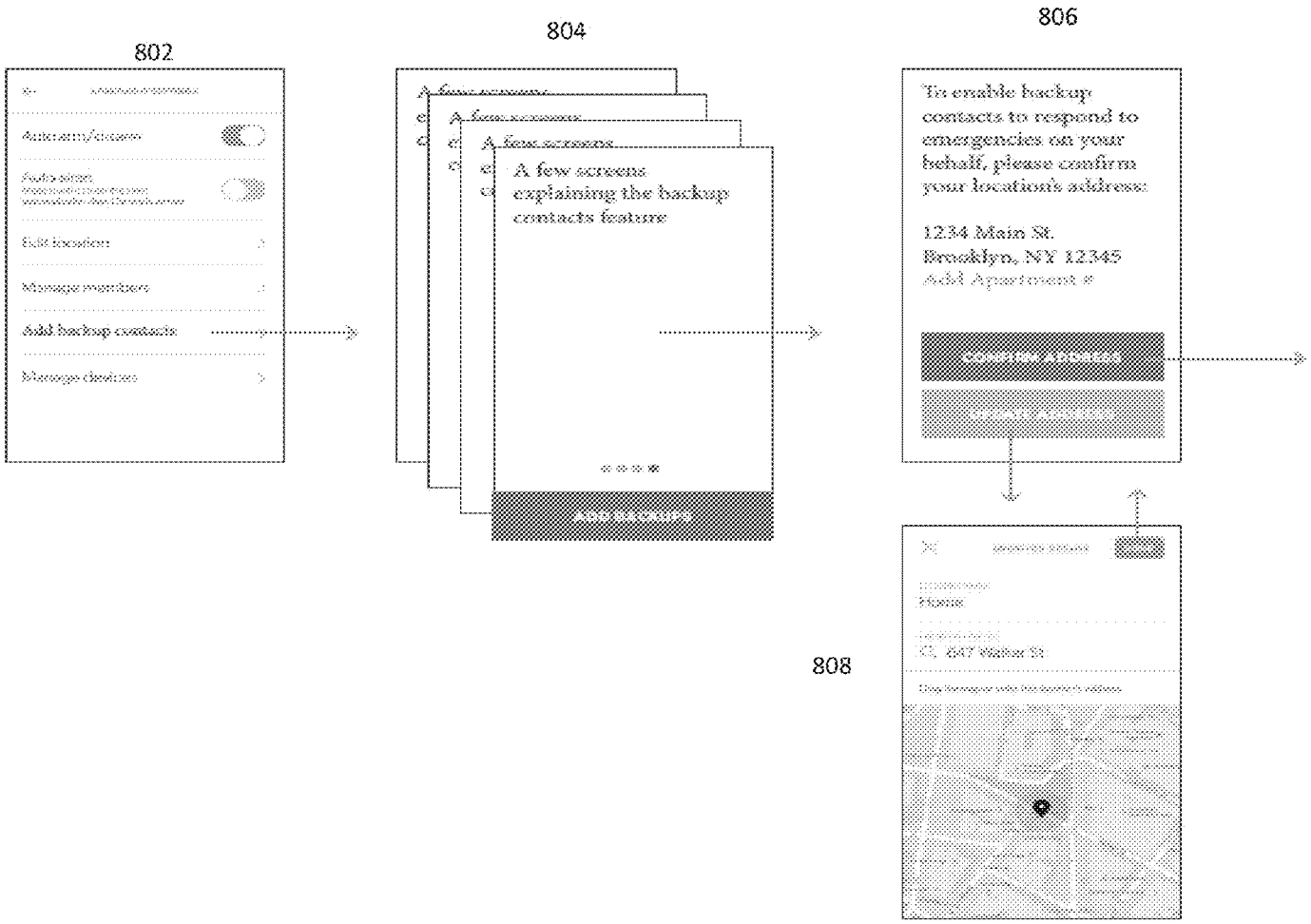
FIGS. 8A and 8B show a schematic representation of an exemplary sequence of communications between a computer-based processing system and one of the persons primarily associated with the monitored space to enable backup contact functionality in the system.
Figure 8B:
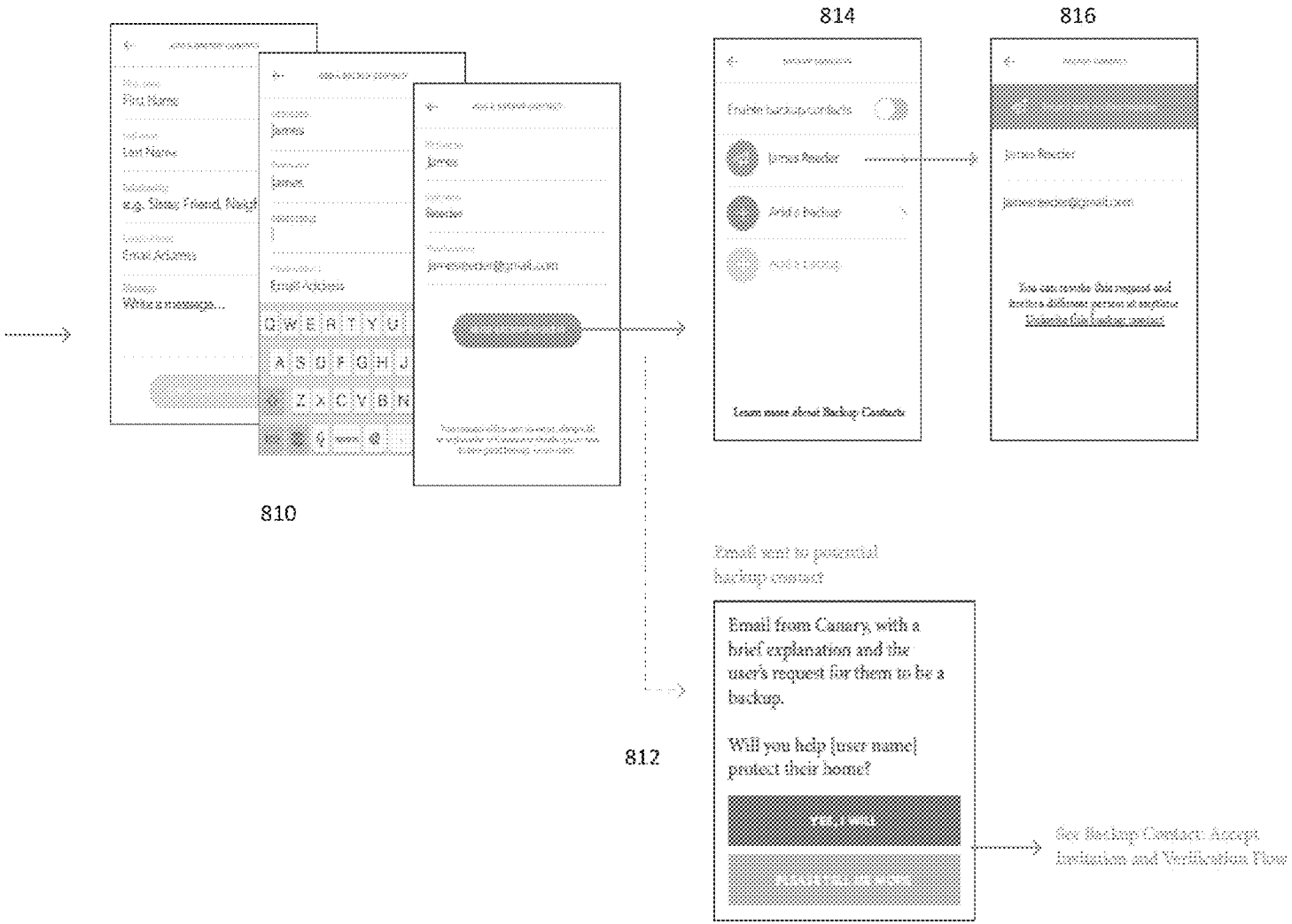

FIGS. 8A and 8B show a schematic representation of an exemplary sequence of communications between a computer-based processing system (e.g., 14 in FIG. 1) and one of the persons primarily associated with the monitored space (e.g., 25 in FIG. 1) to enable backup contact functionality in the system. The illustrated sequence of screenshots may, in a typical implementation, be accessed either on a website or in a software app running on the person's smartphone or the like.

The illustrated sequence includes a settings page 802 that includes, among other things, an "add backup contacts" option.

As shown, selecting the "add backup contacts" option presents one or more screens 804 to the user explaining the backup contacts feature. One or more of these screens may include (e.g., at the bottom of the screen, as shown) a button (link) to "add backups."

According to the illustrated sequence, selecting the "add backups" button causes the system 100 to present to the user an initial screen 806 prompting the user to confirm his or her address in order to enable backup contacts to respond to emergencies on behalf of the user. The screen 806 presents an "update address" button, the selection of which causes the system 100 to present to the user a location detail screen 808 that enables the user to specify a new address. The screen 806 also includes a "confirm address" button, the selection of which enables the user to confirm a particular address associated with the user. The system 100, in a typical implementation, may check the entered address against information about the user stored in an electronic database.

Next, the system 100 presents to the user one or more screens 810 prompting the user to enter personal information for the proposed backup contact. The information solicited in the illustrated example includes name, relationship and email address. On this screen, the system 100 also prompts the user to write a message to the proposed backup contact. An exemplary message in this regard might read, "Dear Jim, I would love for you to be a backup contact for my home security system. Will you help?" or something along those lines. One of these screens 810 in the illustrated implementation includes a "send backup request" button (link), the selection of which causes the system 100 to send an email (or text, etc.) to the proposed backup. An example of an email that the system 100 might send to a proposed backup contact in this regard is shown at 812, for example.

Next, the illustrated sequence includes a "backup contacts" control page 814. This page includes a two position (left-right) button to enable (or disable) backup contact functionality in the corresponding system 100. The screen 814 shows that James Reeder is a proposed backup contact. The screen 814 also provides a button, the selection of which enables the user to add other backup contacts.

Selecting the name "James Reeder" on the screen 814 causes the system 100 to present the backup contact status summary screen 816 for James Reeder. The screen may indicate, for example, that a request has been sent to James Reeder (to be a backup contact) and that the system 100 is awaiting a response from James Reeder to the request. There is also a link, near the bottom of the page 816, the selection of which will revoke the request to James Reeder and enable sending an invite to a different person instead.

Figure 9:
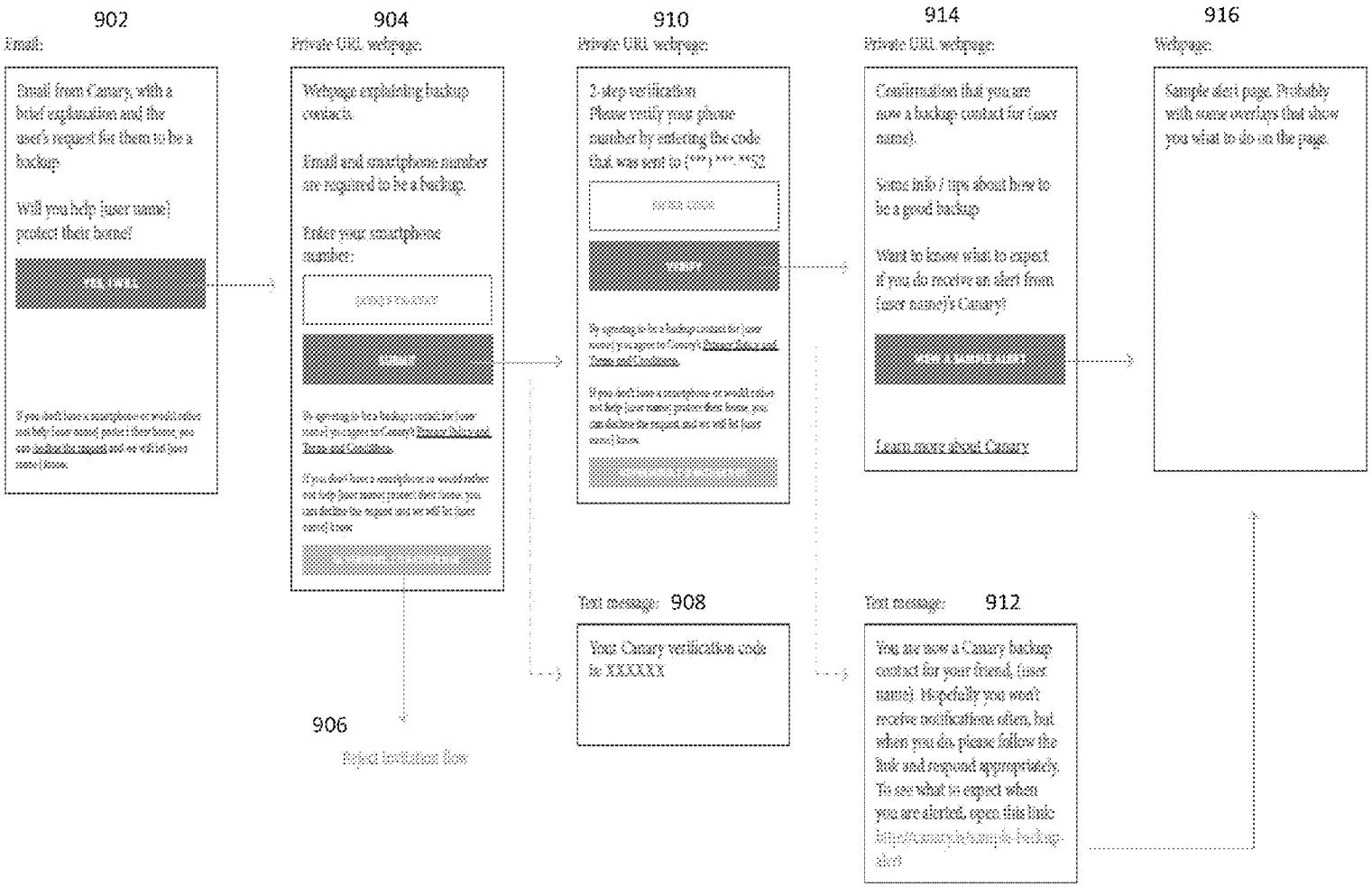
FIG. 9 shows a schematic representation of an exemplary sequence of communications between a computer-based processing system and a proposed backup contact.

FIG. 9 shows a schematic representation of an exemplary sequence of communications between a computer-based processing system (e.g., 14 in FIG. 1) and a proposed backup contact. In the exemplary sequence, the system, pursuant to instructions from one of the persons primarily associated with the monitored space, invites the proposed backup contact to be a backup contact for the monitored space. In the illustrated example, the proposed backup contact accepts the invitation.

More particularly, according to the illustrated sequence, the system 100 first sends an email 902 to the proposed backup contact with a brief explanation and the user's request for them to be a backup contact. The illustrated email message 902 also includes a "Yes I will" button, the selection of which is intended to be an agreement by the proposed backup contact to act as a backup contact to the user. The illustrated email 902 also includes a message to the proposed backup contact to decline the invitation if he or she does not own a smartphone or would rather not help.

Selecting the "Yes I will" button in the illustrated email 902 causes the system 100 to present to the proposed backup contact (at his or her computer device) a webpage 904 to begin signing up as a backup contact. The illustrated webpage 904 explains a bit more about what it means to be a backup contact, it indicates that an email and smartphone number are required and prompts the proposed backup contact to enter his or her smartphone number. The webpage also includes a "Nevermind, I'd rather not" button (link), the selection of which (see 906 "reject invitation flow") indicates to the system 100 that the proposed backup contact will not act as a backup contact.

When the proposed backup contact enters his or her smartphone number and selects the "submit" button (link), the system 100 sends a text message 908 to the smartphone number provided. The text message 908 includes a system verification code. In some implementations, the system may incorporate other types of two-factor authentication (2FA) technologies; one such example involves the Google Authenticator app.

Next (or in parallel), the system 100 presents to the proposed backup contact (at his or her computing device) a verification page 910. The verification page prompts the proposed backup contact to enter the verification code that was sent to his or her smartphone number. Again, the webpage 910 includes a "Nevermind, I'd rather not" button (link), the selection of which (see 906 "reject invitation flow") indicates to the system 100 that the proposed backup contact will not act as a backup contact.

When the proposed backup contact enters the verification code and selects the "verify" button (link), the system 100 sends a text message 912 to the backup contact's smartphone number provided. The text message 912 confirms that the proposed backup contact is now an official backup contact. It also includes a link to more information about what the backup contact might do if he or she is alerted to a possible event at the monitored location.

Next, or concurrently, the system 100 presents a webpage 914 confirming that the proposed backup contact is now an official backup contact. This page 914 may include tips on how to be a good backup contact, and information about what to expect if the backup contact does receive an alert from the system 100. In this regard, page 914 includes a button (link), the selection of which causes the system 100 to present to the backup contact a sample alert page 916, which may include overlays that show what to do on the page.

Figure 10:
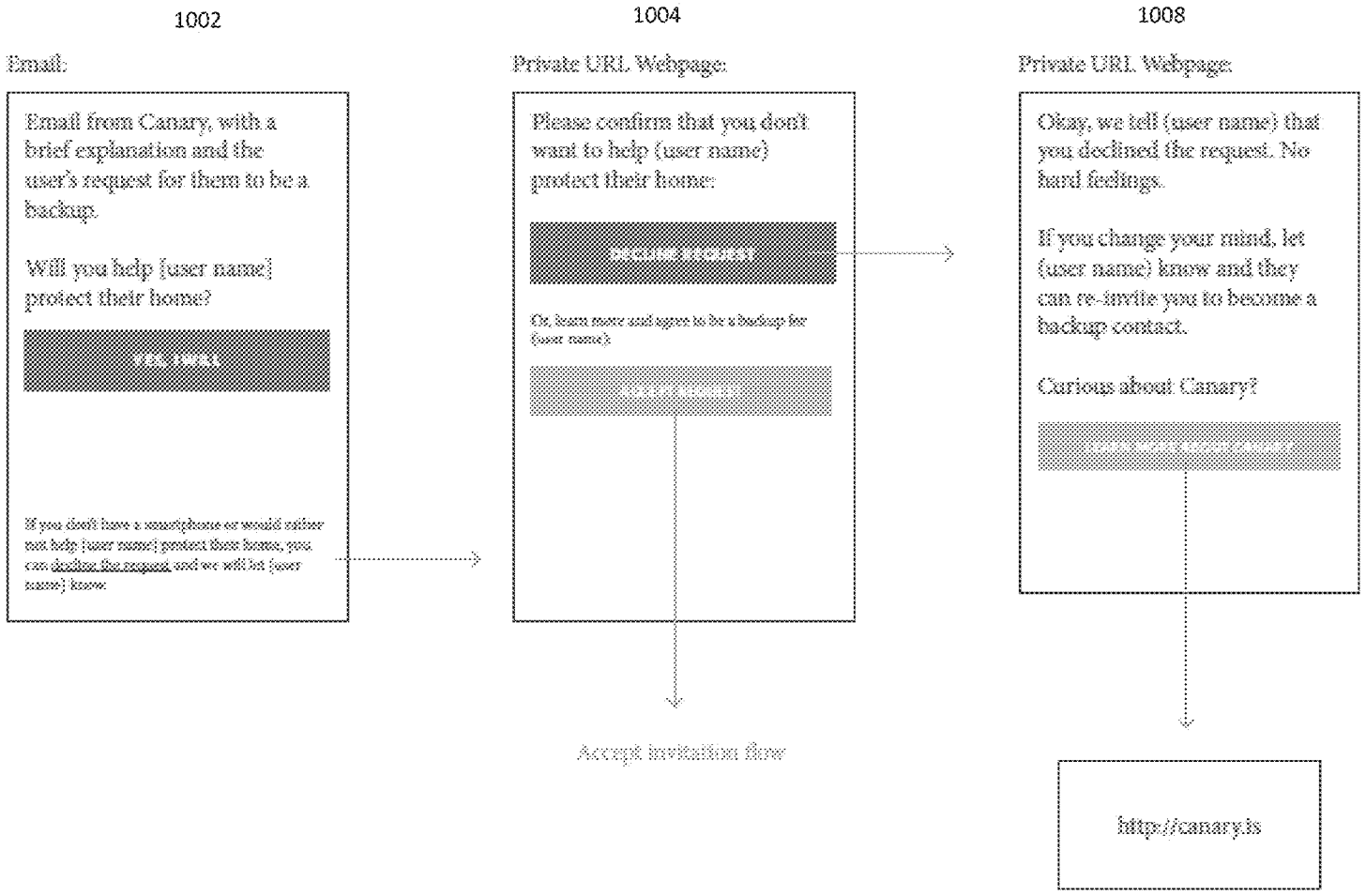
FIG. 10 shows a schematic representation of an exemplary sequence of communications between a computer-based processing system and a proposed backup contact.

FIG. 10 shows a schematic representation of an exemplary sequence of communications between a computer-based processing system (e.g., 14 in FIG. 1) and a proposed backup contact. As in FIG. 9, in the exemplary sequence, the system, pursuant to instructions from one of the persons primarily associated with the monitored space, invites the proposed backup contact to be a backup contact for the monitored space. However, in the example shown in FIG. 10, the proposed backup contact declines the invitation.

More particularly, in the illustrated sequence, the system 100 first sends an email 1002 to the proposed backup contact with a brief explanation and the user's request for them to be a backup contact. The illustrated email message 1002 includes a "Yes I will" button, the selection of which is intended to be an agreement by the proposed backup contact to act as a backup contact to the user. The illustrated email 1002 also includes a message to the proposed backup contact to decline the invitation if he or she does not own a smartphone or would rather not help.

If, as indicated in the illustrated sequence, the proposed backup contact selects the "decline the request" link in the email 1002, the system presents a confirmation screen 1004 asking the proposed backup contact to confirm that they are declining the request. The illustrated screen 1004 includes a "decline request" button (link), the selection of which causes the system to conclude that the request to be a backup contact has been declined, and an "accept request" button (link), the selection of which causes the system to follow an accept invitation flow—not represented in FIG. 10 in any detail.

When the proposed backup contact selects the "decline request" button in 1004, the system presents page 1008 essentially confirming the declining backup contact's decision. This page includes a link to information about "Canary" (e.g., the system 100 in FIG. 1), the selection of which causes the system to present a webpage with additional information about the system.

Figure 11:
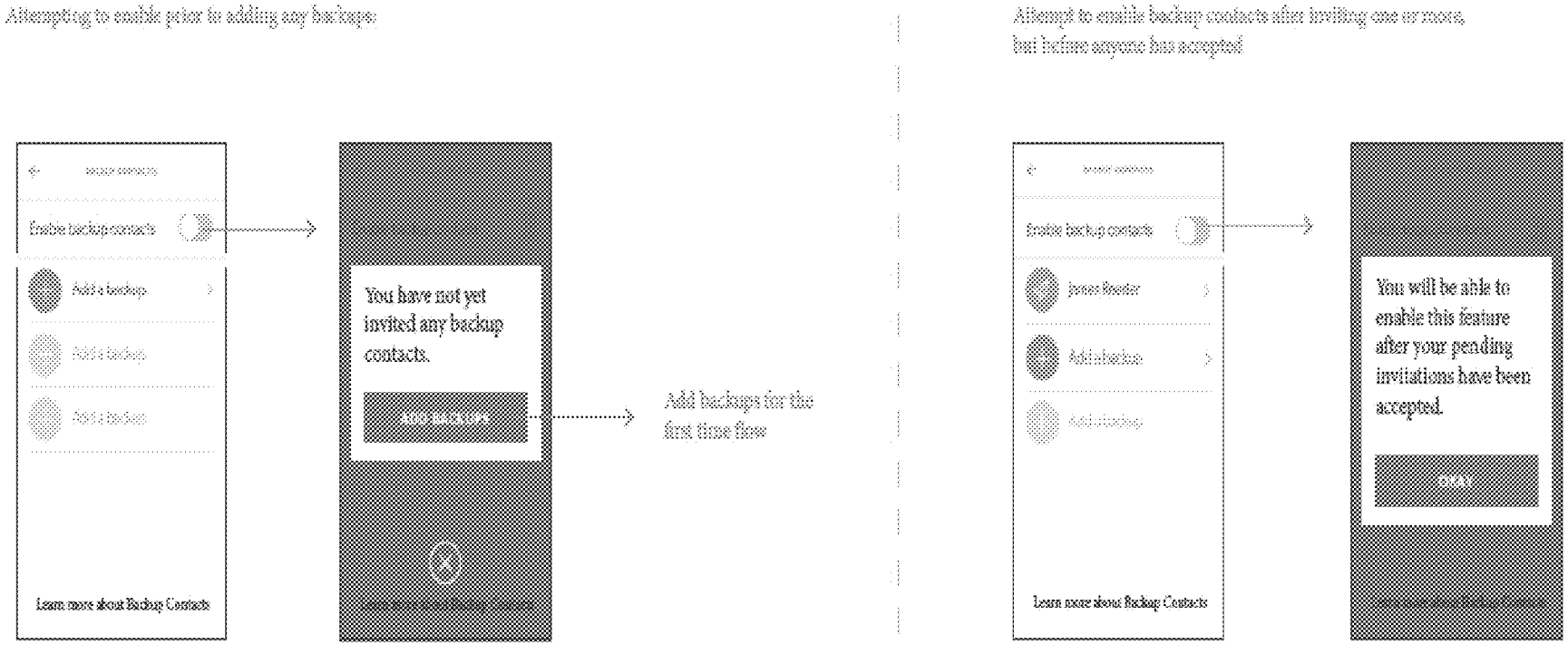
FIG. 11 shows an exemplary series of screenshots that a person primarily associated with a monitored space would see: 1) if he or she attempts to enable backup contact functionality prior to adding any backup contacts, and 2) if he or she attempts to enable backup contacts after inviting one or more potential backup contacts, but none of the invitations has been accepted.

FIG. 11 shows an exemplary series of screenshots (e.g., on a user device 24) that a person primarily associated with a monitored space would see: 1) if he or she attempts to enable backup contact functionality prior to adding any backup contacts, and 2) if he or she attempts to enable backup contacts after inviting one or more potential backup contacts, but none of the invitations has been accepted.

Figure 12:
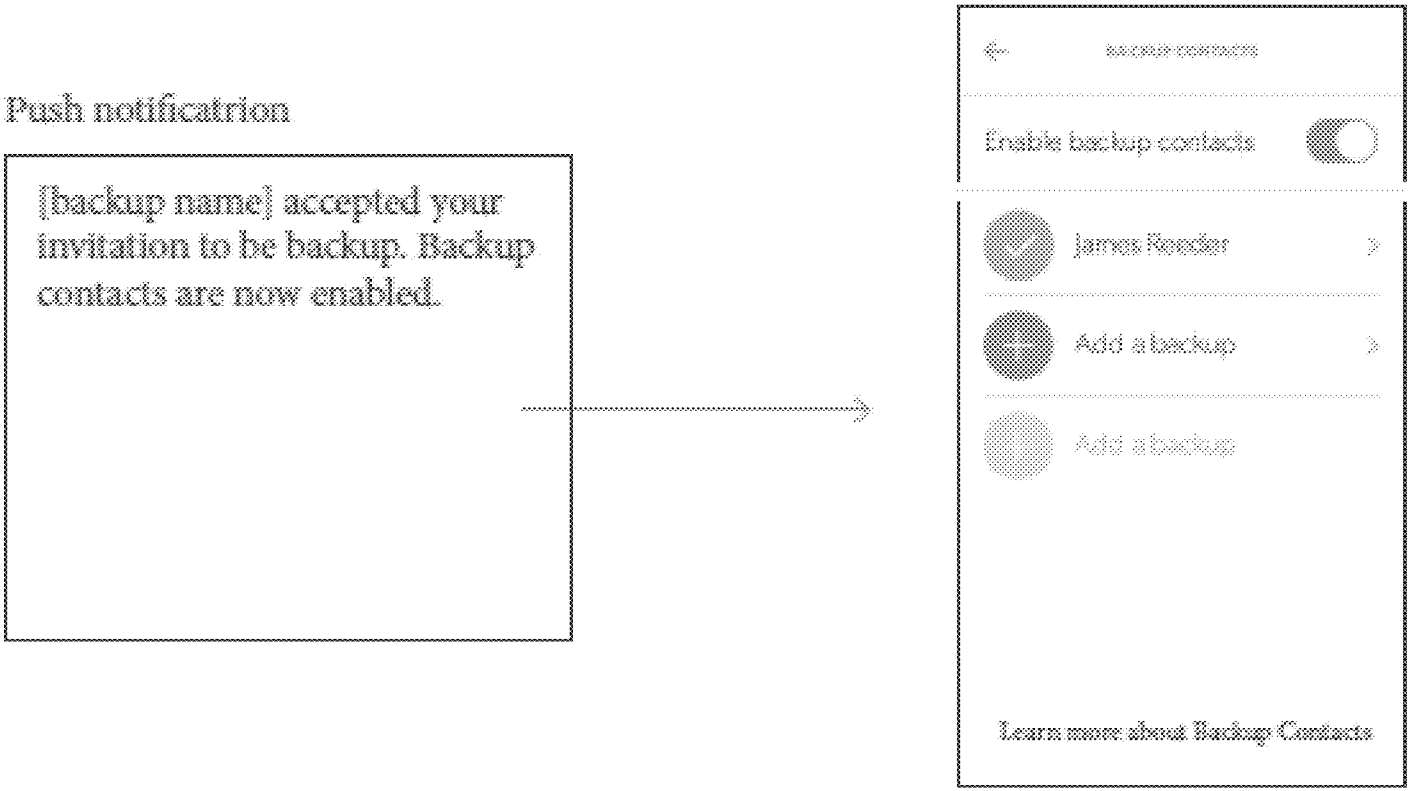
FIG. 12 shows an example of a message that a person primarily associated with a monitored space would see, in one implementation, if a proposed back up contact has accepted an invitation to be a backup contact.

FIG. 12 shows an example of a message that a person primarily associated with a monitored space would see, in one implementation, if a proposed back up contact has accepted an invitation to be a backup contact. It also shows that the person primarily associated with the monitored space would then, in one implementation, be presented with the screen that lets the person enable backup contact functionality.

In a typical implementation, certain aspects of the functionality that persons primarily associated with the monitored space can access via their user devices 24 are by virtue of a software application.

A number of embodiments of the invention have been described. Nevertheless, it will be understood that various modifications may be made without departing from the spirit and scope of the invention.

For example, the screenshots shown herein can appear completely different. Moreover, the specific order and format of the various communications to persons primarily associated with the monitored space and/or the backup contacts can vary. Moreover, the number of communications that are sent to the persons primarily associated with the monitored space and/or the backup contacts can vary. The timing between actions (e.g., subsequent communications) can vary. Additionally, these and other items can vary depending on a perceived urgency of the event that the system determines could be happening at the monitored space.

The term link, and the like, as used herein, should be construed broadly. In one example, a link may be a highlighted word or picture in a document, web page, text, email, push notification, etc. that you can click on with a computer mouse, for example, to go to another place in the same or a different document, web page, app, etc. One example of a link is a hyperlink.

To be clear, a single monitored space (e.g., a home or a work space, etc.) can, of course, and often does have multiple backup contacts. Moreover, in a typical implementation, whether it's the primary users or one or more of the backup contacts, the first person to acknowledge (either passively or actively) an events stops the system from escalating. So, if there are three backup contacts, the first backup to view (or otherwise acknowledge) the event information may stop the escalation, and one or more notifications along those lines will be sent to any primary user(s)—i.e., users who reside at the monitored space.

There are a variety of ways in which users (e.g., primary users and backup contacts) can interact and view system information. For example, in some implementations, the system may have: 1) registered users who can download an app (e.g., onto their computer-based mobile devices) that facilitates system interactions and can provide an enhanced interactive experience with the system to registered users, and 2) unregistered users (typically backup contacts who have not downloaded the app to facilitate system interactions).

In some implementations, the system is configured to interact with registered users with push notifications (and/or texts, emails, etc.) from the downloaded app. In those implementations, the system may be configured to interact with unregistered users via texts, emails, etc., but not push notifications.

Likewise, in some implementations, the registered users can access system information (e.g., to view a timeline of events associated with the corresponding monitored space, to view video clips from the monitored space, etc.) through the app, which may provide a richer experience than other access platforms. However, in a typical implementation, the user may also be able to access the system information through a web-based portal or otherwise. Moreover, in those implementations, access for the unregistered users may be restricted to non-app platforms (e.g., the web-based portal, etc.).

In various implementations, the system 100 may be adapted, in certain circumstances, to trigger an alarm in the monitored space and/or auto-contact the police, fire department or other emergency personnel and/or take other actions not specifically mentioned herein.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal that is generated to encode information for transmission to suitable receiver apparatus for execution by a data processing apparatus.

Computer-readable instructions to implement one or more of the techniques disclosed herein can be stored on a computer storage medium. Computer storage mediums (e.g., a non-transitory computer readable medium) can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources. The term "data processing apparatus" (e.g., a processor or the like) encompasses all kinds of apparatus, devices, and machines for processing data, including by way of example a programmable processor, a computer, a system on a chip, or multiple ones, or combinations, of the foregoing. Moreover, use of the term data processing apparatus should be construed to include multiple data processing apparatuses working together. Similarly, use of the term memory or memory device or the like should be construed to include multiple memory devices working together.

Computer programs (also known as programs, software, software applications, scripts, or codes) can be written in any form of programming language, including compiled or interpreted languages, declarative or procedural languages, and can be deployed in any form.

The processes and logic flows described in this specification can be performed by one or more programmable processors executing one or more computer programs to perform actions by operating on input data and generating output. Processors suitable for the execution of a computer program include, by way of example, both general and special purpose microprocessors, and any one or more processors of any kind of digital computer. Generally, a processor will receive instructions and data from a read-only memory or a random access memory or both.

A computer device adapted to implement or perform one or more of the functionalities described herein can be embedded in another device, e.g., a mobile telephone, a personal digital assistant (PDA), a mobile audio or video player, a game console, a Global Positioning System (GPS)

receiver, or a portable storage device (e.g., a universal serial bus (USB) flash drive), to name just a few.

Devices suitable for storing computer program instructions and data include all forms of non-volatile memory, media and memory devices, including, for example semiconductor memory devices, e.g., EPROM, EEPROM, and flash memory devices; magnetic disks, e.g., internal hard disks or removable disks; magneto-optical disks; and CD-ROM and DVD-ROM disks.

To provide for interaction with a user, embodiments of the subject matter described in this specification can be implemented using a computer device having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Other implementations are within the scope of the claims.

What is claimed is:

1. A method comprising:

receiving an indication that an event has occurred in a physical space being monitored by a monitoring device that includes a plurality of sensors;

in response to the indication, sending one or more primary notifications of the event over a computer-based network to each of one or more persons primarily associated with the physical space being monitored; and if after a designated amount of time, none of the primary notifications have been viewed by any of the persons primarily associated with the physical space being monitored, sending a backup notification of the event over the computer-based network to one or more persons designated as backup contacts, wherein the backup notification is logically associated with information that the one or more backup contacts can access about the event, wherein each person primarily associated with the physical space being monitored resides or works at, at least part-time, or has an interest in the monitored space, and the person designated as a backup contact does not reside or work at or have the interest in the monitored physical space.

2. The method of claim 1, wherein the logical association is embodied by a link in the backup notification.

3. The method of claim 1, wherein the event is one that has been identified, by computer-based logic based on data collected by the monitoring device, as a potentially undesirable event.

4. The method of claim 1, wherein each of the one or more primary notifications and the backup notification are accessible from computer-based devices.

5. The method of claim 1, wherein the information about the event comprises a description of data relating to the event collected by the monitoring device.

6. The method of claim 1, wherein the information about the event comprises a video of the physical space during the event.

7. The method of claim 1, further comprising:

enabling the person designated as a backup contact to indicate, after selecting the link to information about the event and viewing the information about the event, that, no further attention needs to be paid to the event.

8. The method of claim 7, further comprising:

in response to an indication from the person designated as a backup contact that no further attention needs to be paid to the event:

sending an electronic communication over the computer-based network to notify one or more of the persons primarily associated with the physical space being monitored of the backup contact's indication.

9. The method of claim 8, further comprising:

sending an electronic communication over the computer-based network to the person designated as a backup contact confirming the backup contact's indication that no further attention needs to be paid to the event.

10. The method of claim 1, wherein the monitoring device comprises:

a housing;

the sensors are inside or coupled to the housing and comprise one or more of the following: a video camera, optionally with night vision capability, a microphone, a temperature sensor, a humidity sensor, an air quality sensor, a motion detector, a carbon monoxide sensor and an accelerometer.

11. The method of claim 1, wherein the interest in the monitored physical space is an ownership interest.

12. A method comprising:

receiving an indication that an event has occurred in a physical space being monitored by a monitoring device that includes a plurality of sensors:

in response to the indication, sending one or more primary notifications of the event over a computer-based network to each of one or more persons primarily associated with the physical space being monitored; and if, after a designated amount of time, none of the primary notifications have been viewed by any of the persons primarily associated with the physical space being monitored, sending a backup notification of the event over the computer-based network to one or more persons designated as backup contacts, wherein the backup notification is logically associated with information that the one backup contacts can access about the event, wherein the information about the event comprises one or more of the following:

instructions on how to respond to the backup notification;

a phone number for one or more of the people primarily associated with the physical space;

a phone number for police, fire department and/or emergency medical services sufficiently proximate to the physical space to provide a timely response at the physical space, if needed;

an address of the physical space;

a map showing the location of the physical space on a map; and data associated with the physical space collected by from one or more of the plurality of sensors.

13. The method of claim 12, wherein one or more of the phone numbers is configured to appear on a touch sensitive screen associated with the computer-based device as a phone number that can be dialed automatically by touching the touch sensitive screen where the phone number appears.

14. A method comprising:

receiving an indication that an event has occurred in a physical space being monitored by a monitoring device that includes a plurality of sensors;

in response to the indication, sending one or more primary notifications of the event over a computer-based network to each of one or more persons primarily associated with the physical space being monitored; and if, after a designated amount of time, none of the primary notifications have been viewed by any of the persons primarily associated with the physical space being monitored, sending a backup notification of the event over the computer-based network to one or more persons designated as backup contacts, wherein the backup notification is logically associated with information that the one or more backup contacts can access about the event; and enabling the one or more of the persons primarily associated with the physical space being monitored to send out an invitation, over the computer-based network, to another person inviting that person to he a designated backup contact for the physical space being monitored.

15. A method comprising:

receiving an indication that an event has occurred in a physical space being monitored by a monitoring device that includes a plurality of sensors;

in response to the indication, preparing a first primary notification of the event;

sending the first primary notification of the event over a computer-based network to each one of one or more persons primarily associated with the physical space being monitored;

if, after a designated amount of time, none of the first primary notifications have been viewed by any of the persons primarily associated with the physical space being monitored, sending a second primary notification of the event over the computer-based network, via text, email, push notification, or some combination thereof, to one or more of the persons primarily associated with the physical space being monitored;

if, after a designated amount of time, none of the second primary notifications have been viewed or acknowledged by any of the persons primarily associated with the physical space being monitored, sending a backup notification of the event over the computer-based network to one or more persons designated as backup contacts; and pushing a notification to one or more of the persons primarily associated with the physical space being monitored that one or more of the persons designated as backup contacts has been notified.

16. The method of claim 15, wherein sending the backup notification of the event comprises sending a text, an email, a push notification, or some combination thereof to the one or more persons designated as backup contacts.

17. The method of claim 15, wherein the backup notification is logically associated with information that the one or more backup contacts can access about the event.

18. The method of claim 15, Wherein the backup notification has a link to information about the event.

19. A computer-based system comprising:

a monitoring device at a physical space to be monitored, wherein the monitoring device comprises a plurality of sensors and a communications module;

a computer-based processing system coupled to the monitoring device via a computer-based network, wherein the computer-based processing system comprises a computer-based processor, a memory storage device, and a communications module; and one or more computer-based devices coupled to the computer-based processing system via the computer-based network, wherein the computer-based processing system is configured to:

receive an indication that an event has occurred in the physical space being monitored by the monitoring device;

in response to the indication, send one or more primary notifications of the event over the computer-based network to each one of one or more persons primarily associated with the physical space being monitored; and if, after a designated amount of time, none of the primary notifications have been viewed by any of the persons primarily associated with the physical space being monitored, send a backup notification of the event over the computer-based network to one or more persons designated as backup contacts, wherein the backup notification has a link to information about the event, wherein each person primarily associated with the physical space being monitored resides or works, at least part-time, at or has an interest in the monitored space, and the person designated as a backup contact does not reside or work at or have the interest in the monitored physical space.

20. The computer-based system of claim 19, wherein the one or more primary notifications and the backup notifications are accessible from one or more of the computer-based devices.

21. The computer-based system of claim 19, wherein the event is one that has been identified, by computer-based logic based on data collected by the monitoring device, as a potentially undesirable event.

22. The computer-based system of claim 19, wherein the information about the event comprises a description of data relating to the event collected by the monitoring device.

23. The computer-based system of claim 19, wherein the information about the event comprises a video of the physical space during the event.

24. The computer-based system of claim 19, wherein one or more of the phone numbers is configured to appear on a touch sensitive screen associated with one of the computer-based devices as a phone number that can be dialed automatically by touching the touch sensitive screen where the phone number appears.

25. The computer-based system of claim 19, wherein the monitoring device comprises a housing, and wherein the sensors are inside or coupled to the housing and comprise one or more of the following; a video camera, optionally with night vision capability, a microphone, a temperature sensor, a humidity sensor, an air quality sensor, a motion detector, a carbon monoxide sensor and an accelerometer.

26. The computer-based system of claim 19, wherein the interest in the monitored physical space is an ownership interest.

27. A computer-based system comprising:

a monitoring device at a physical space to be monitored, wherein the monitoring device comprises a plurality of sensors and a communications module;

a computer-based processing system coupled to the monitoring device via a computer-based network, wherein the computer-based processing system comprises a computer-based processor, a memory storage device, and a communications module; and one or more computer-based devices coupled to the computer-based processing system via the computer-based network, wherein the computer-based processing system is configured to:

receive an indication that an event, has occurred in the physical space being monitored by the monitoring device;

in response to the indication, send one or more primary notifications of the event over the computer-based network to each one of one or more persons primarily associated with the physical space being monitored; and if, after a designated amount of time, none of the primary notifications have been viewed by any of the persons primarily associated with the physical space being monitored, send a backup notification of the event over the computer-based network to one or more persons designated as backup contacts, wherein the backup notification has a link to information about the event, wherein the information about the event comprises one or more of the following:

instructions on how to respond to the backup notification;

a phone number for one or more of the people primarily associated with the physical space;

a phone number for police, fire department and/or emergency medical services sufficiently proximate to the physical space to provide a timely response at the physical space, if needed;

an address of the physical space;

a web map showing the location of the physical space on a map; and data associated with the physical space collected by from one or more of the plurality of sensors.

28. The computer-based system of claim 27, wherein the data associated with the physical space includes video data collected by a video camera physically located at the monitored space.

29. A computer-based system comprising:

a monitoring device at a physical space to be monitored, wherein the monitoring device comprises a plurality of sensors and a communications module;

a computer-based processing system coupled to the monitoring device via a computer-based network, wherein the computer-based processing system comprises a computer-based processor, a memory storage device, and a communications module; and one or more computer-based devices coupled to the computer-based processing system via the computer-based network, wherein the computer-based processing system is configured to:

receive an indication that an event has occurred in the physical space being monitored by the monitoring device;

in response to the indication, send one or more primary notification of the event over the computer-based network to each one of one or more persons primarily associated with the physical space being monitored; and if, after a designated amount of time, none of the primary notifications have been viewed by any of the persons primarily associated with the physical space being monitored, send a backup notification of the event over the computer-based network to one or more persons designated as backup contacts, wherein the backup notification has a link to information about the event, wherein the computer-based processing system is configured to enable the person designated as a backup contact to indicate, after selecting the link to information about the event and viewing the information about the event, that, no further attention needs to be paid to the event, and wherein the computer-based processing system is further configured so that, in response to an indication from the person designated as a backup contact that no further attention needs to be paid to the event, the computer-based processing system sends an electronic communication over the computer-based network to notify one or more of the persons primarily associated with the physical space being monitored of the backup contact's indication.

30. A computer-based system comprising:

a monitoring device at a physical space to be monitored, wherein the monitoring device comprises a plurality of sensors and a communications module;

a computer-based processing system coupled to the monitoring device via a computer-based network, wherein the computer-based processing system comprises a computer-based processor, a memory storage device, and a communications module; and one or more computer-based devices coupled to the computer-based processing system via the computer-based network, wherein the computer-based processing device is configured to:

receive an indication that an event has occurred in a physical space being monitored by the monitoring device;

in response to the indication, prepare a first primary notification of the event;

push the first primary notification of the event over the computer-based network to each one of one or more persons primarily associated with the physical space being monitored;

if, after a designated amount of time, none of the first primary notifications have been viewed by any of the persons primarily associated with the physical space being monitored, send a second primary notification of the event over the computer-based network, via text, email, push notification or some combination thereof, to one or more of the persons primarily associated with the physical space being monitored;

if after a designated amount of time, none of the second primary notifications have been viewed or acknowledged by any of the persons primarily associated with the physical space being monitored, send a backup notification of the event over the computer-based network to one or more persons designated as backup contacts.

31. The computer-based system of claim 30, wherein sending the backup notification of the event comprises sending a text, an email or both to the one or more persons designated as backup contacts.

32. The computer-based system of claim 30, wherein the backup notification has a link to information about the event.

33. The computer-based system of claim 30, wherein the computer-based processing system is further configured to:

push a notification to one or more of the persons primarily associated with the physical space being monitored that one or more of the persons designated as backup contacts has been notified.

* * * * *